US011230454B2

(12) United States Patent
Haruna

(10) Patent No.: US 11,230,454 B2
(45) Date of Patent: Jan. 25, 2022

(54) SHEET CONVEYANCE APPARATUS AND IMAGE FORMING SYSTEM

(71) Applicant: CANON KABUSHIKI KAISHA, Tokyo (JP)

(72) Inventor: Jun Haruna, Tagata-gun (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/928,068

(22) Filed: Jul. 14, 2020

(65) Prior Publication Data

US 2021/0024318 A1 Jan. 28, 2021

(30) Foreign Application Priority Data

Jul. 26, 2019 (JP) ..... JP2019-138321

(51) Int. Cl.
*B65H 29/60* (2006.01)
*B65H 29/12* (2006.01)
(Continued)

(52) U.S. Cl.
CPC ..... *B65H 29/60* (2013.01); *B65H 29/125* (2013.01); *B65H 29/14* (2013.01); *B65H 29/145* (2013.01); *B65H 29/20* (2013.01); *B65H 31/3027* (2013.01); *B65H 33/08* (2013.01); *B65H 43/00* (2013.01); *B65H 2301/162* (2013.01); *B65H 2301/361* (2013.01); *B65H 2301/4213* (2013.01); *B65H 2403/942* (2013.01); *B65H 2404/1424* (2013.01); *B65H 2511/12* (2013.01); *B65H 2801/06* (2013.01)

(58) Field of Classification Search
CPC ..... B65H 2404/1424; B65H 2301/361; B65H 2301/162; B65H 29/60; B65H 31/24; B65H 2301/33312; B65H 29/20; B65H 43/00; B65H 29/14; B65H 2403/942; B65H 2511/12; B65H 2801/06; B65H 2301/4213
See application file for complete search history.

(56) References Cited

U.S. PATENT DOCUMENTS 7,401,776 B2 7/2008 Obuchi et al.
7,445,207 B2 11/2008 Obuchi et al.
(Continued)

FOREIGN PATENT DOCUMENTS

JP 2007-76776 A 3/2007
JP 2007-091466 A 4/2007
(Continued)

*Primary Examiner* — Jeremy R Severson
(74) *Attorney, Agent, or Firm* — Venable LLP

(57) ABSTRACT

A sheet conveyance apparatus includes a first conveyance path, a detection portion, a second conveyance path, a discharge unit, and a controller. The discharge unit is movable in a width direction and is configured to perform a discharge operation of discharging a sheet onto a first discharge portion and a reversing operation of reversing and conveying the sheet to the second conveyance path. The controller is configured to control the discharge unit and to execute a first alignment control when the reversing operation is performed. The first alignment control is a control in which the discharge unit moves the sheet in the width direction based on a position of the sheet detected by the detection portion to align the sheet at a target position.

12 Claims, 24 Drawing Sheets

(51) Int. Cl.

| | |
|---|---|
| ***B65H 29/20*** | (2006.01) |
| ***B65H 43/00*** | (2006.01) |
| ***B65H 29/14*** | (2006.01) |
| ***B65H 31/30*** | (2006.01) |
| ***B65H 33/08*** | (2006.01) |

(56) References Cited

U.S. PATENT DOCUMENTS

| | | | | |
|---|---|---|---|---|
| 7,575,230 | B2 | 8/2009 | Kamiya et al. | |
| 7,766,326 | B2 | 8/2010 | Obuchi et al. | |
| 7,887,037 | B2 | 2/2011 | Kamiya et al. | |
| 7,954,811 | B2 * | 6/2011 | Ishikawa | G03G 15/6582 271/245 |
| 9,309,076 | B2 * | 4/2016 | Kato | B65H 31/02 |
| 10,066,681 | B2 * | 9/2018 | Kadowaki | B65H 33/08 |
| 10,351,382 | B2 | 7/2019 | Moriya et al. | |
| 10,562,731 | B2 * | 2/2020 | Nakano | B26F 1/04 |
| 2017/0183189 | A1 * | 6/2017 | Matsuki | B65H 33/08 |

FOREIGN PATENT DOCUMENTS

| | | |
|---|---|---|
| JP | 2017-149501 A | 8/2017 |
| JP | 2018-144913 A | 9/2018 |

* cited by examiner

SHEET CONVEYANCE APPARATUS AND IMAGE FORMING SYSTEM

BACKGROUND OF THE INVENTION

Field of the Invention

The present invention relates to a sheet conveyance apparatus configured to convey a sheet and to an image forming system configured to form an image on the sheet.

Description of the Related Art

Some image forming apparatus such as an electro-photographic printer is optionally provided with a sheet processing unit configured to perform a process such as a binding process or a sorting process on sheets on which images have been formed in an apparatus body of the image forming apparatus, and stack the processed sheets as a product. Some of such sheet processing unit is provided with a shift mechanism configured to shift the sheets received from the image forming apparatus in a width direction in order to enhance alignment accuracy of sheets on a processing tray or to enhance alignment accuracy of the sheets just discharged without performing any process. Japanese Patent Application Laid-open No. 2007-76776 discloses a sheet processing unit in which a shift unit is disposed upstream of a buffering roller for buffering sheets to be processed and which overlays the sheets to be buffered on one another while offsetting the sheets in a width direction such that they are readily aligned in the width direction on the processing tray.

By the way, if such shift unit corresponding to each individual discharge destination is to be disposed in a sheet conveyance apparatus having a function of conveying sheets while distributing to a plurality of discharge destinations, a structure of the apparatus is unnecessarily complicated and thus increases costs.

SUMMARY OF THE INVENTION

The present invention provides a new sheet conveyance apparatus that is capable of aligning sheets in a configuration with a plurality of discharge portion, and an image forming system including the same.

According to one aspect of the invention, a sheet conveyance apparatus includes a first conveyance path through which a sheet is conveyed toward a first discharge portion, a detection portion provided on the first conveyance path and configured to detect a position of the sheet in a width direction perpendicular to a discharge direction toward the first discharge portion, a second conveyance path which is branched from the first conveyance path and through which the sheet reversed from the discharge direction in the first conveyance path is conveyed in a case where the sheet is to be discharged to a second discharge portion other than the first discharge portion, a discharge unit provided downstream in the discharge direction of a position where the second conveyance path branches from the first conveyance path, the discharge unit being movable in the width direction and being configured to perform a discharge operation of discharging the sheet onto the first discharge portion and a reversing operation of reversing and conveying the sheet to the second conveyance path, and a controller configured to control the discharge unit and to execute a first alignment control when the reversing operation is performed. The first alignment control is a control in which the discharge unit moves the sheet in the width direction based on the position of the sheet detected by the detection portion to align the sheet at a target position.

According to another aspect of the invention, a sheet conveyance apparatus includes a first conveyance path through which a sheet is conveyed toward a first discharge portion, a detection portion provided on the first conveyance path and configured to detect a position of the sheet in a width direction perpendicular to a discharge direction toward the first discharge portion, a second conveyance path which is branched from the first conveyance path and through which the sheet reversed from the discharge direction in the first conveyance path is conveyed in a case where the sheet is to be discharged to a second discharge portion other than the first discharge portion, a discharge unit provided downstream in the discharge direction of a position where the second conveyance path branches from the first conveyance path, the discharge unit being movable in the width direction and being configured to perform a discharge operation of discharging the sheet onto the first discharge portion and a reversing operation of reversing and conveying the sheet to the second conveyance path, a conveyance unit provided on the second conveyance path and capable of nipping and conveying the sheet in a forward conveyance direction and a backward conveyance direction in the second conveyance path, the discharge unit and the conveyance unit being configured to perform a buffering operation of buffering a plurality of sheets, which are conveyed one by one through the first conveyance path, by overlaying the plurality of sheets on one another, and a controller configured to control the discharge unit and to execute an alignment control when the buffering operation is performed. The alignment control is a control in which the discharge unit moves and adjusts a position in the width direction of a preceding sheet having arrived at the discharge unit in the width direction in accordance to a position detected by the detection portion on a succeeding sheet conveyed toward the discharge unit following the preceding sheet.

Further features of the present invention will become apparent from the following description of exemplary embodiments with reference to the attached drawings.

DESCRIPTION OF THE EMBODIMENTS

Exemplary embodiments of the present invention will be described below with reference to drawings.

First Exemplary Embodiment

Figure 1:
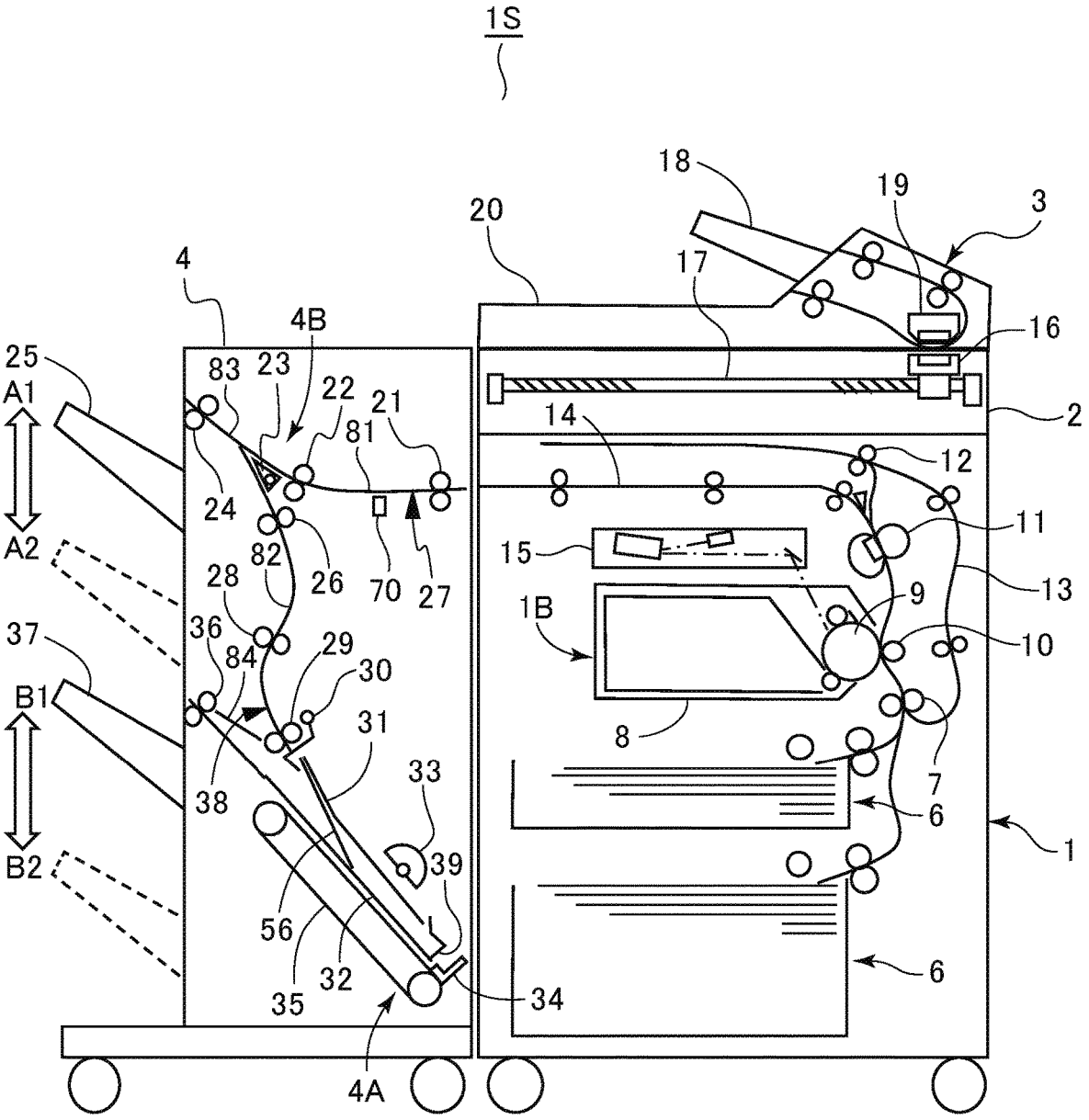
FIG. 1 is a schematic diagram of an image forming system according to a first exemplary embodiment.

FIG. 1 is a schematic view of an image forming system 1S according to a first exemplary embodiment. The image forming system 1S of the present exemplary embodiment includes an image forming apparatus 1, an image reading apparatus 2, a document feeding apparatus 3, and a post-processing apparatus 4. The image forming system 1S forms an image on a sheet serving as a recording material, and outputs the sheet after processing the sheet by the post-processing apparatus 4 if necessary. Hereinafter, simple description of the operation of each apparatus will be given, and then the post-processing apparatus 4 will be described in detail.

The document feeding apparatus 3 conveys a document placed on a document tray 18 to image reading portions 16 and 19. The image reading portions 16 and 19 are image sensors that read image information from respective document surfaces, and both surfaces of a document are read in one time of conveyance of the document. The document whose image information has been read is discharged onto a document discharge portion 20. In addition, the image reading apparatus 2 can read image information from a still document set on a platen glass, by reciprocating the image reading portion 16 by a driving device 17. Examples of the still document include documents such as booklet documents for which the document feeding apparatus 3 cannot be used.

The image forming apparatus 1 is an electrophotographic apparatus including an image forming portion 1B of a direct transfer system. The image forming portion 1B includes a cartridge 8 including a photosensitive drum 9, and a laser scanner unit 15 disposed above the cartridge 8. In the case of performing an image forming operation, the surface of the rotating photosensitive drum 9 is charged, and the laser scanner unit 15 draws an electrostatic latent image on the surface of the photosensitive drum 9 by exposing the photosensitive drum 9 on the basis of image information. The electrostatic latent image born on the photosensitive drum 9 is developed into a toner image by charged toner particles, and the toner image is transferred to a transfer portion where the photosensitive drum 9 and a transfer roller 10 face each other. The controller of the image forming apparatus 1, which is a printer controller 100 that will be described later, executes an image forming operation by the image forming portion 1B on the basis of image information read by the image reading portions 16 and 19 or image information received from an external computer via a network.

The image forming apparatus 1 includes a plurality of feeding apparatuses 6 that feed sheets serving as recording materials one by one at a predetermined interval. A sheet fed from a feeding apparatus 6 is conveyed to the transfer portion after the skew thereof is corrected by a registration roller pair 7, and in the transfer portion, the toner image born on the photosensitive drum 9 is transferred thereto. A fixing unit 11 is disposed downstream of the transfer portion in a conveyance direction of the sheet. The fixing unit 11 includes a rotary member pair that nips and conveys the sheet, and a heat generating member such as a halogen lamp for heating the toner image, and performs image fixing processing on the toner image on the sheet by heating and pressurizing the toner image.

In the case of discharging the sheet having undergone image formation to the outside of the image forming apparatus 1, the sheet having passed through the fixing unit 11 is conveyed to the post-processing apparatus 4 via a horizontal conveyance portion 14. In the case of a sheet image formation on a first surface of which is finished in duplex printing, the sheet having passed through the fixing unit 11 is passed onto a reversing roller pair 12, switched back and conveyed by the reversing roller pair 12, and conveyed to the registration roller pair 7 again via a re-conveyance portion 13. Then, an image is formed on a second surface of the sheet as a result of the sheet passing through the transfer portion and the fixing unit 11 again, and then the sheet is conveyed to the post-processing apparatus 4 via the horizontal conveyance portion 14.

The image forming portion 1B described above is an example of an image forming portion that forms an image on a sheet, and an electrophotographic unit of an intermediate transfer system that transfers a toner image formed on a photosensitive member onto a sheet via an intermediate transfer member may be used therefor. In addition, a printing unit of an inkjet system or an offset printing system may be used as the image forming portion.

Post-Processing Apparatus

The post-processing apparatus 4 includes a binding processing portion 4A that performs a binding process on sheets received from the image forming apparatus 1, and discharges the sheets as a sheet bundle. In addition, the post-processing apparatus 4 is also capable of simply discharging a sheet received from the image forming apparatus 1 without performing a binding process thereon.

The post-processing apparatus 4 includes an entry path 81, an in-body discharge path 82, a first discharge path 83, and a second discharge path 84 as a conveyance path for conveying a sheet, and an upper discharge tray 25 and a lower discharge tray 37 are provided as discharge destinations onto which a sheet is discharged. The entry path 81 and the first discharge path 83 serve as a first conveyance path of the present exemplary embodiment through which a sheet received from the image forming apparatus 1 is conveyed and discharged onto the upper discharge tray 25. The in-body discharge path 82 serves as a second conveyance path of the present exemplary embodiment which branches from the first conveyance path and through which a sheet reversed in the first conveyance path is conveyed toward the binding processing portion 4A. The second discharge path 84 is a conveyance path serving as a third conveyance path through which the sheet having delivered to the binding processing portion 4A is discharged onto the lower discharge tray 37. The upper discharge tray 25 as a first discharge tray serves as a first discharge portion of the present exemplary embodiment. The lower discharge tray 37 as a second discharge tray serves as a second discharge portion of the present exemplary embodiment.

On the entry path 81, an entrance roller pair 21, a pre-buffering roller pair 22, an entrance sensor 27, and a lateral position detection sensor 70 are disposed. On the first discharge path 83, a discharging-reversing roller pair 24 serving as a reversing unit is disposed. On the in-body discharge path 82, an in-body discharge roller pair 26, an intermediate conveyance roller pair 28, a kick-out roller pair 29, and a pre-intermediate supporting sensor 38 are disposed. On the second discharge path 84, a bundle discharge roller pair 36 is disposed. The entrance sensor 27 and the pre-intermediate supporting sensor 38 each serve as an example of a sheet detection portion that detects passage of a sheet at a predetermined detection position in a conveyance path in a sheet processing apparatus. As the entrance sensor 27 and the pre-intermediate supporting sensor 38, optical sensors that detect presence/absence of a sheet at the detection position by using light as will be described later can be used.

A sheet conveyance path in the post-processing apparatus 4 will be described below. To be noted, a buffering operation by a buffering portion 4B including the discharging-reversing roller pair 24, and the detailed configuration and operation of the binding processing portion 4A will be described later.

The sheet discharged from the horizontal conveyance portion 14 of the image forming apparatus 1 is received by the entrance roller pair 21, and is conveyed toward the pre-buffering roller pair 22 through the entry path 81. The entrance sensor 27 detects the sheet at a detection position between the entrance roller pair 21 and the pre-buffering roller pair 22. In addition, the lateral position detection sensor 70 is disposed between the detection position of the entrance sensor 27 and the pre-buffering roller pair 22 and detects a position (hereinafter referred to as a lateral position of the sheet) of the sheet in a width direction of the sheet perpendicular to the conveyance direction of the sheet. The pre-buffering roller pair 22 convey the sheet received from the entrance roller pair 21 toward the first discharge path 83.

To be noted, at a predetermined timing after the entrance sensor 27 has detected passage of a trailing end of the sheet, the sheet conveyance speed of the pre-buffering roller pair 22 is increased to a speed higher than the conveyance speed in the horizontal conveyance portion 14. In addition, the sheet conveyance speed of the entrance roller pair 21 may be set to be higher than that in the horizontal conveyance portion 14, and the conveyance speed may be increased by the entrance roller pair 21 upstream of the pre-buffering roller pair 22. In this case, it is preferable that a one-way clutch is disposed between a conveyance roller of the horizontal conveyance portion 14 and a motor that drives the conveyance roller such that the conveyance roller idles even when the sheet is pulled by the entrance roller pair 21.

In the case where the discharge destination of the sheet is the upper discharge tray 25, the discharging-reversing roller pair 24 performs a discharge operation to discharge the sheet received from the pre-buffering roller pair 22 onto the upper discharge tray 25. In this case, the discharging-reversing roller pair 24 decelerates to a predetermined discharge speed at a predetermined timing after the trailing end of the sheet has passed through the pre-buffering roller pair 22.

In the case where the discharge destination of the sheet is the lower discharge tray 37, the discharging-reversing roller pair 24 performs a reversing operation to switch back and convey the sheet received from the pre-buffering roller pair 22 toward the in-body discharge path 82. A non-return flap 23 is provided at a branching portion upstream of the discharging-reversing roller pair 24 in the sheet discharge direction of the discharging-reversing roller pair 24 where the entry path 81 and the in-body discharge path 82 branch from the first discharge path 83. The non-return flap 23 has a function of suppressing backward movement of the sheet switched back by the discharging-reversing roller pair 24 into the entry path 81.

The in-body discharge roller pair 26, the intermediate conveyance roller pair 28, and the kick-out roller pair 29 disposed on the in-body discharge path 82 convey the sheet received from the discharging-reversing roller pair 24 toward the binding processing portion 4A while passing the sheet onto one another. The pre-intermediate supporting sensor 38 detects the sheet at a position between the intermediate conveyance roller pair 28 and the kick-out roller pair 29.

The binding processing portion 4A includes a stapler serving as a binding unit of the present exemplary embodiment, and staples a predetermined position of the sheet bundle by the stapler after aligning a plurality of sheets received from the in-body discharge path 82. The detailed configuration and operation of the binding processing portion 4A will be described later. The sheet bundle stapled by the binding processing portion 4A is passed onto a bundle discharge roller pair 36 through the second discharge path 84 serving as a third conveyance path, and is discharged onto the lower discharge tray 37 by the bundle discharge roller pair 36 serving as a discharge member.

The upper discharge tray 25 and the lower discharge tray 37 are both capable of moving up and down with respect to the casing of the post-processing apparatus 4. The post-processing apparatus 4 includes sheet surface detection sensors that respectively detect positions of upper surfaces of sheets, that is, the height of sheets supported on the upper discharge tray 25 and the lower discharge tray 37, and when either of the sensors detects a sheet, lowers the corresponding tray in an A2 or B2 direction. In addition, when it is detected by the sheet surface detection sensors that the sheets on the upper discharge tray 25 or the lower discharge tray 37 have been removed, the corresponding tray is lifted in an A1 or B1 direction. Therefore, the upper discharge tray 25 and the lower discharge tray 37 are controlled to ascend/descend in accordance with a supported sheet amount on each tray so as to maintain the upper surface of supported sheets at a constant height.

Buffering Portion

Figure 2:
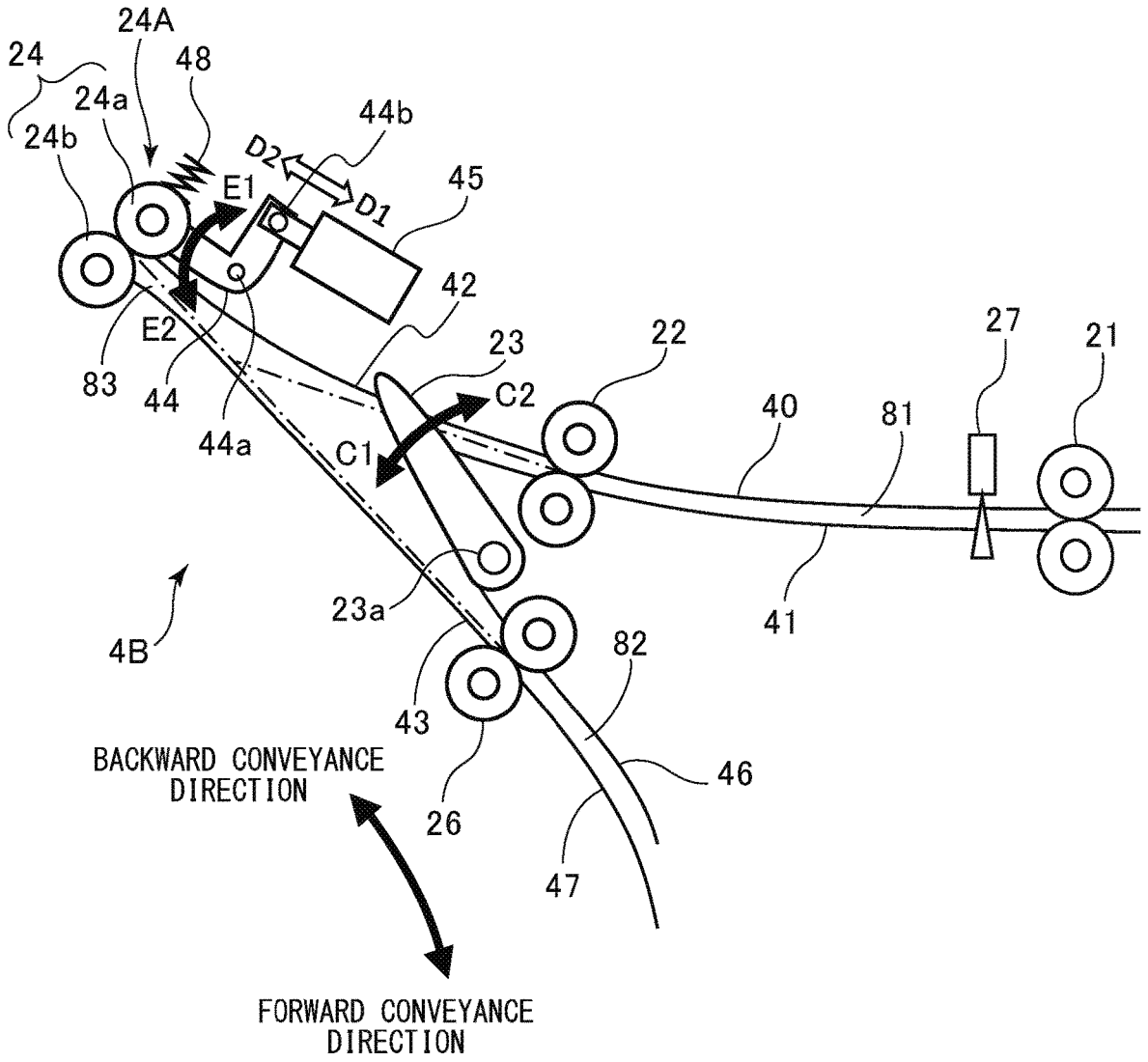
FIG. 2 is a schematic diagram of a buffering portion according to the first exemplary embodiment.

Next, the buffering portion 4B serving as a buffer mechanism of the present exemplary embodiment will be described in detail with reference to FIG. 2. FIG. 2 is a schematic view of the buffering portion 4B, which includes a shift conveyance mechanism 24A serving as a discharge unit of the present exemplary embodiment. As illustrated in FIG. 2, the buffering portion 4B of the present exemplary embodiment includes the discharging-reversing roller pair 24 serving as a reverse conveyance roller pair, the non-return flap 23, and in-body discharge roller pair 26 serving as an intermediate roller pair. In addition, the entrance roller pair 21, the pre-buffering roller pair 22, and the entrance sensor 27 disposed on the entry path 81 also contribute to the buffering operation.

Conveyance guides making up the sheet conveyance path between the entrance roller pair 21 and the pre-buffering roller pair 22, that is, a part of the entry path 81, will be referred to as an "entrance upper guide 40" and an "entrance lower guide 41". In addition, conveyance guides making up the sheet conveyance path between the in-body discharge roller pair 26 and the intermediate conveyance roller pair 28, that is, a part of the in-body discharge path 82, will be referred to as an "in-body discharge upper guide 46" and an "in-body discharge lower guide 47". Further, a conveyance guide that guides the sheet from the same side as the entrance upper guide 40 at a position between the pre-buffering roller pair 22 and the discharging-reversing roller pair 24 will be referred to as a "reverse conveyance upper guide 42". In addition, a conveyance guide that guides the sheet from the same side as the in-body discharge lower guide 47 at a position between the discharging-reversing roller pair 24 and the in-body discharge roller pair 26 will be referred to as a "reverse conveyance lower guide 43".

The sheet conveyed by the entrance roller pair 21 is guided to the pre-buffering roller pair 22 by the entrance upper guide 40 and the entrance lower guide 41. The entrance sensor 27 is disposed on the entrance upper guide 40. As the entrance sensor 27, a reflection-type photosensor that radiates infrared light toward the entry path 81 and detects reflection light from the sheet to determine presence/absence of the sheet at a detection position can be used. In this case, a hole having a size equal to or bigger than the diameter of spotting light of the entrance sensor 27 is provided in the entrance lower guide 41 at a position opposing the entrance sensor 27 such that the infrared light is not reflected when the sheet is not passing through.

The non-return flap 23 is disposed at the portion downstream of the pre-buffering roller pair 22 where the entry path 81 and the in-body discharge path 82 branch from the first discharge path 83. The non-return flap 23 is rotatably supported with respect to the in-body discharge upper guide 46 via a rotation shaft 23*a*. In addition, the non-return flap 23 is urged all the time by an unillustrated spring in a C2 direction, that is, a clockwise direction in FIG. 2, toward a position of FIG. 2 where the distal end portion of the non-return flap 23 overlaps with the reverse conveyance upper guide 42 as viewed in the axial direction of the rotation shaft 23*a*, that is, the width direction of the sheet. In addition, the spring constant of the spring mentioned above is set to such a value that when the sheet delivered out from the pre-buffering roller pair 22 abuts the non-return flap 23, the non-return flap 23 pivots in a C1 direction, that is, a counterclockwise direction in FIG. 2, against the urging force of the spring. Therefore, the non-return flap 23 allows passage of the sheet conveyed from the pre-buffering roller pair 22 toward the discharging-reversing roller pair 24. Meanwhile, when the trailing end of the sheet in the entry path 81 passes the non-return flap 23, the non-return flap 23 pivots in the C2 direction to suppress backward movement of the sheet from the discharging-reversing roller pair 24 to the pre-buffering roller pair 22.

The discharging-reversing roller pair 24 includes a reverse upper roller 24*a* and a reverse lower roller 24*b*. In the present exemplary embodiment, driving force is input to both of the reverse conveyance upper and lower rollers 24*a* and 24*b*, and rotation of the reverse upper roller 24*a* and rotation of the reverse lower roller 24*b* are synchronized all the time.

The discharging-reversing roller pair 24 is configured to abut and separate from each other by a plunger solenoid 45, which serves as a separation unit in the present embodiment. Specifically, one end of a separation lever 44 is coupled to a roller shaft of the reverse upper roller 24*a*, and the separation lever 44 is supported so as to be rotatable about a lever support shaft 44*a* with respect to the reverse conveyance upper guide 42. A solenoid coupling shaft 44*b* provided on the other end of the separation lever 44 is coupled to a plunger of the plunger solenoid 45.

When power is supplied to the plunger solenoid 45, the plunger is attracted in a D1 direction by magnetic force, the separation lever 44 rotates in an E1 direction, and the discharging-reversing roller pair 24 transitions to a separate state in which a nip portion of the roller pair is open. When the supply of power to the plunger solenoid 45 is stopped, the reverse upper roller 24*a* abuts the reverse lower roller 24*b* by an urging force of a pressurizing spring 48 coupled to the roller shaft of the reverse upper roller 24*a*, and the discharging-reversing roller pair 24 transitions to an abutting state in which the nip portion is closed. At this time, the separation lever 44 rotates in an E2 direction in accordance with the movement of the reverse upper roller 24*a*, and the plunger of the plunger solenoid 45 moves in a D2 direction.

The in-body discharge roller pair 26 are a roller pair next to the reverse conveyance roller pair 24 in a sheet conveyance direction in the in-body discharge path 82, and are capable of rotating in a normal rotation direction and in a reverse rotation direction. That is, the in-body discharge roller pair 26 is capable of conveying the sheet in both of the sheet conveyance direction from the reverse conveyance roller pair 24 toward the binding processing portion 4A, that is, a forward conveyance direction in the in-body discharge path 82, and a backward conveyance direction from the binding processing portion 4A toward the reverse conveyance roller pair 24.

Shift Conveyance Mechanism

Figure 3A:
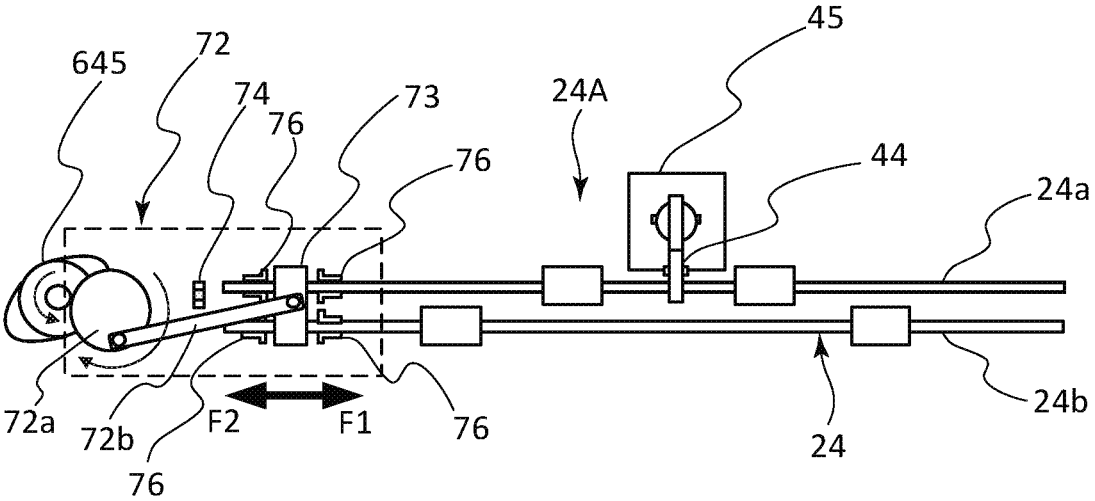
FIG. 3A is a schematic diagram illustrating a shift conveyance mechanism according to the first exemplary embodiment.

Next, the shift conveyance mechanism 24A serving as a discharge unit of the present exemplary embodiment will be described with reference to FIGS. 3A and 3B. FIG. 3A is a schematic diagram illustrating the shift conveyance mechanism 24A viewed from downstream in the sheet discharge direction of the discharging-reversing roller pair 24 and FIG. 3B is a schematic diagram illustrating a configuration for detecting a home position of the shift conveyance mechanism 24A.

As illustrated in FIG. 3A, the shift conveyance mechanism 24A includes the discharging-reversing roller pair 24 serving as a roller pair and a shift crank mechanism 72 serving as a moving mechanism that moves the roller pair in the width direction. The shift crank mechanism 72 is connected with a shift motor 645 serving as a driving source and transmits rotation outputted by the shift motor 645 to the discharging-reversing roller pair 24 by converting into a linear motion in the sheet width direction, i.e., in an axial direction of the discharging-reversing roller pair 24 as indicated by F1 and F2.

The shift crank mechanism 72 is composed of a rotating plate 72*a*, a link 72*b* and a slider 73. The rotating plate 72*a* includes a gear portion engaging with an output gear of the shift motor 645. The slider 73 is supported by roller shafts of reverse upper and lower rollers 24*a* and 24*b* of the discharging-reversing roller pair 24 and is slidable in the axial direction of the roller shafts. The roller shafts of the reverse upper and lower rollers 24*a* and 24*b* are provided with sandwiching members 76 configured to be movable in the axial direction with respect to a frame of the post-processing apparatus 4 and to sandwich the slider 73 in the axial direction. The link 72*b* links the rotating plate 72*a* with the slider 73 and slides the slider 73 in the F1 and F2 directions along with the rotation of the shift crank mechanism 72.

Figure 3B:
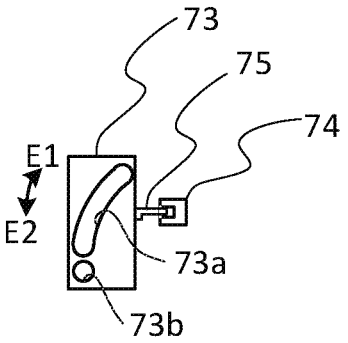
FIG. 3B is a schematic diagram illustrating a slider constituting a part of the shift conveyance mechanism according to the first exemplary embodiment.

As illustrated in FIG. 3B, the slider 73 is provided with a shaft hole 73*a* through which the roller shaft of the reverse upper roller 24*a* penetrates and a shaft hole 73*b* through which the roller shaft of the reverse lower roller 24*b* penetrates. Note that FIG. 3B is a schematic diagram illustrating the slider 73 viewed in the axial direction of the discharging-reversing roller pair 24. Here, the shaft hole 73*a* corresponding to the reverse upper roller 24*a* is formed to be a long hole extending along a moving locus (see FIG. 2) of the roller shaft of the reverse upper roller 24*a* when the reverse upper and lower rollers 24*a* and 24*b* are brought into contact or are separated by the plunger solenoid 45. Accordingly, the shift crank mechanism 72 can shift the reverse upper and lower rollers 24*a* and 24*b* in parallel with contacting and separating of the reverse upper and lower rollers 24*a* and 24*b* while keeping the rotation state of the reverse upper and lower rollers 24*a* and 24*b*.

The shift crank mechanism 72 also includes a home position sensor 74 configured to detect a position, i.e., the home position, which is a standard of the shift operation of the discharging-reversing roller pair 24 in the width direction, i.e., in the shift direction of the shift conveyance mechanism, and a light-shielding flag 75 attached to the slider 73. A photo interrupter that is shielded by the light-shielding flag 75 when the discharging-reversing roller pair 24 is located at the home position can be used as the home position sensor 74. A control circuit of the sheet processing apparatus described later can acquire a current position of the discharging-reversing roller pair 24 based on a rotational amount of the shift motor 645 from a point of time when the home position sensor 74 detects the home position of the discharging-reversing roller pair 24 most recently.

Lateral Position Detection Sensor

Next, a configuration for detecting a position of a sheet to be shifted by the shift conveyance mechanism 24A will be described with reference to FIG. 4. As described above, the post-processing apparatus 4 of the present exemplary embodiment includes a lateral position detection sensor 70 serving as a detection portion for detecting a lateral position, i.e., a widthwise sheet position, of the sheet passing through the entry path 81.

Figure 4:
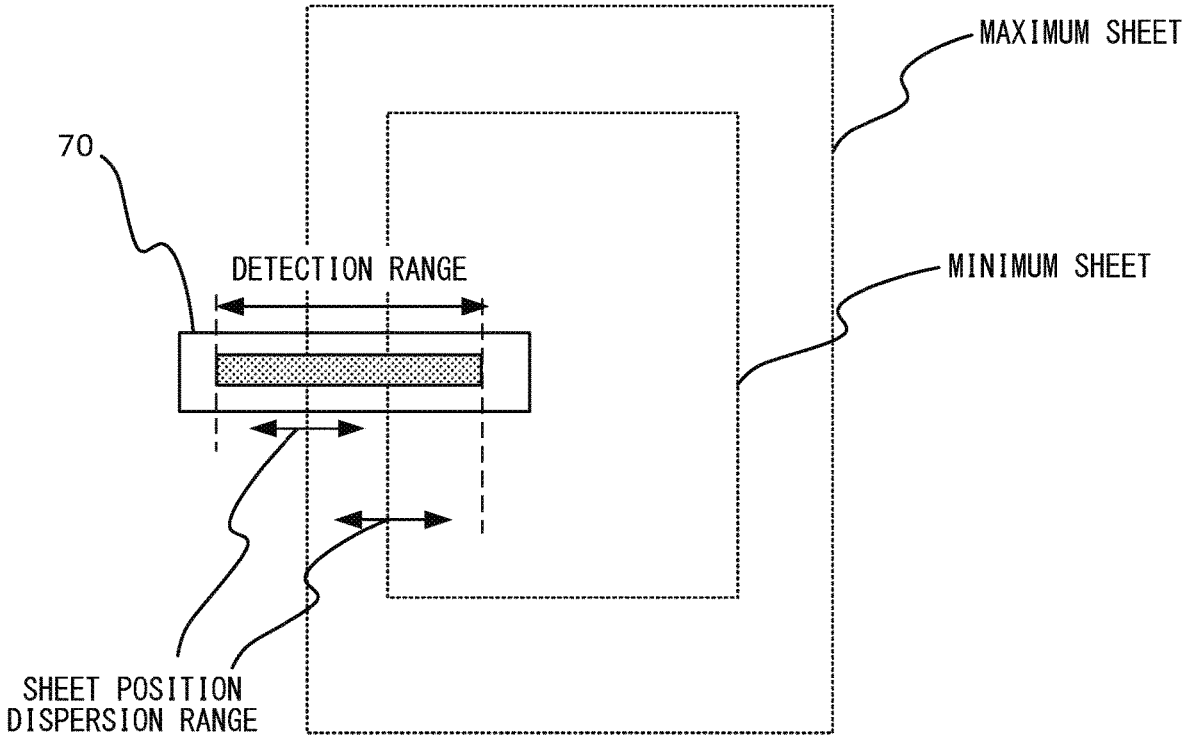
FIG. 4 is a schematic diagram schematically illustrating a disposition of a lateral position detection sensor of the first exemplary embodiment.

FIG. 4 is a schematic diagram illustrating a relationship between a position of the sheet passing through the entry path 81 and a detection range of the lateral position detection sensor 70. A vertical direction in FIG. 4 is a sheet conveyance direction in the entry path 81 and a lateral direction in FIG. 4 is a sheet width direction.

As illustrated in FIG. 4, the lateral position detection sensor 70 is configured to detect positions of one widthwise side end of all sheets from a minimum sheet to a maximum sheet that can be received by the post-processing apparatus 4. That is, the detection range of the lateral position detection sensor 70 extends to a widthwise inner side more than a standard position where a side edge of the minimum sheet passes through so that the detection range includes a disperse range of positions of the side edge of the minimum sheet with respect to the standard position, where the dispersion is presumed to occur during a period in which the minimum sheet undergoes an image forming operation in the image forming apparatus 1 and conveyed to the entry path 81 of the post-processing apparatus 4. The detection range of the lateral position detection sensor 70 also extends to a widthwise outer side more than a standard position where a side edge of the maximum sheet passes through so that the detection range includes a disperse range of positions of the side edge of the maximum sheet with respect to the standard position, where the dispersion is presumed to occur during a period in which the maximum sheet undergoes an image forming operation in the image forming apparatus 1 and conveyed to the entry path 81 of the post-processing apparatus 4. Here, the standard position where the side edge of the minimum sheet or the maximum sheet passes through refers to a position where the side edge of the sheet passes through in a case where there is no widthwise positional deviation or no skew of the sheet.

The present exemplary embodiment uses a line sensor in which a plurality of detection elements, such as photo interrupters, each of which detects whether a sheet is present is arrayed in the width direction as the lateral position detection sensor 70. Due to that, a boundary position on the line sensor between the detection element detecting the sheet and the neighboring detection sensor not detecting the sheet corresponds to a lateral position of the sensor. Because a position of the line sensor with respect to the entry path 81 is fixed, it is possible to find a deviation amount of the lateral position with respect to the standard position of the sheet that has passed through the lateral position detection sensor 70 by appropriately converting the boundary position of the detection position of the detection elements.

Configuration of Image Forming System

Figure 5:
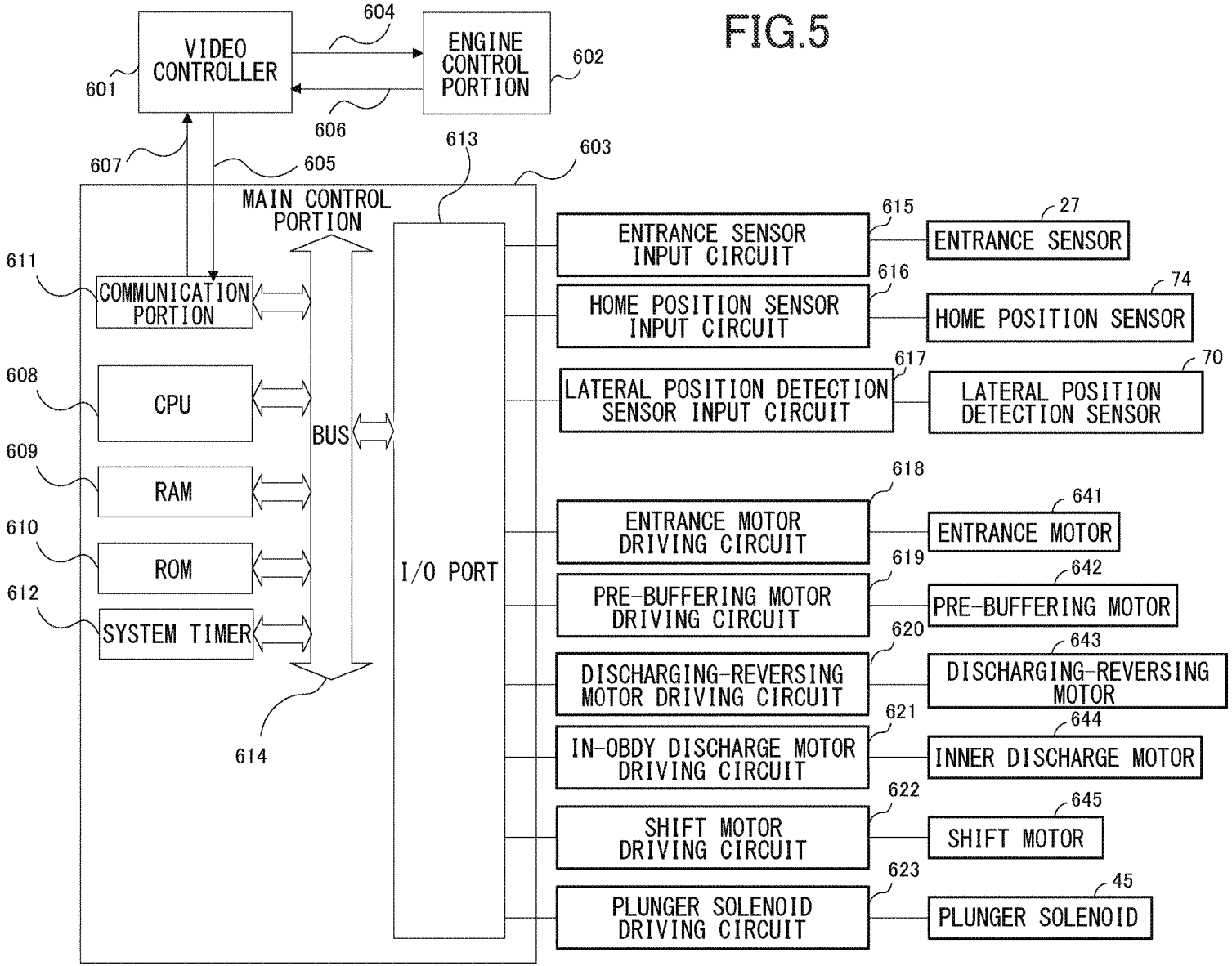
FIG. 5 is a configuration diagram of the image forming system of the first exemplary embodiment.

Next, a hardware structure of the image forming system of the present exemplary embodiment will be described. FIG. 5 represents the hardware structure of the image forming system 1S illustrated in FIG. 1. In FIG. 1, a video controller 601 and an engine control portion 602 are mounted in the image forming apparatus 1 and other component parts are mounted in the post-processing apparatus 4 unless specified otherwise.

The video controller 601 generally controls the image forming apparatus 1 and the post-processing apparatus 4. The engine control portion 602 executes an image forming operation conducted by the image forming portion 1B. The video controller 601 and the engine control portion 602 are connected to be bilaterally communicable through signal lines 604 and 606. The video controller 601 is connected to be bilaterally communicable with a main control portion 603 of the post-processing apparatus 4 through signal lines 605 and 607.

In controlling the operation of the image forming system 1S, the video controller 601 transmits a serial command to the engine control portion 602 and the main control portion 603 through the signal lines 604 and 605. The video controller 601 also acquires a present state of the system by receiving status data from the engine control portion 602 and the main control portion 603 through signal lines 606 and 607. Thus, in a case where a plurality of units is connected and operates as one system, the video controller 601 controls the respective units and manages the state to keep consistency of the operation among the respective units.

Note that various operations of the post-processing apparatus 4 described below are controlled basically by the main control portion 603 of the post-processing apparatus 4 in the present exemplary embodiment. However, it is possible to arrange such that a controller of another unit connected to the control circuit of the post-processing apparatus 4 bears part or whole contents of the control.

The main control portion 603 serving as a controller of the present exemplary embodiment includes a CPU 608, a RAM 609, a ROM 610, a communication portion 611, a system timer 612 and an I/O port 613, and these circuit elements constitute the control circuit by being connected through a bus 614. The CPU 608 serves as an execution portion configured to control the various operations of the post-processing apparatus 4 by reading and executing programs stored in the ROM 610 and others. The RAM 609 temporarily stores control data required for the operations of the post-processing apparatus 4. The ROM 610 is a non-volatile storage unit storing the programs to be executed by the CPU 608 and control tables required in the operation of the post-processing apparatus 4. The ROM 610 is one example of a non-transitory storage medium storing a control program for operating the post-processing apparatus 4 by a specific method.

The communication portion 611 has a communication function by which the main control portion 603 communicates with the video controller 601. The system timer 612 is used to generate timing signals required in the various controls. The I/O port 613 serves as an interface for inputting/outputting control signals transmitted from the CPU 608 to the various units within the post-processing apparatus 4.

A circuit configuration of various sensors and actuators installed in the post-processing apparatus 4 is connected to the main control portion 603 through the I/O port 613. An entrance sensor input circuit 615 inputs a signal from the entrance sensor 27 to the main control portion 603 after performing processing, such as amplification or binarization, on the signal. A home position sensor input circuit 616 inputs a signal from the home position sensor 74 to the main control portion 603 after processing the signal. A lateral position detection sensor input circuit 617 inputs a signal from the lateral position detection sensor 70 after processing the signal. An entrance motor driving circuit 618, a pre-buffering motor driving circuit 619 and a discharging-reversing motor driving circuit 620 drive an entrance motor 641, a pre-buffering motor 642 and a discharging-reversing motor 643, respectively, based on a control signal received from the main control portion 603. Similarly to that, an in-body discharge motor driving circuit 621, a shift motor driving circuit 622 and a plunger solenoid driving circuit 623 drive an in-body discharge motor 644, a shift motor 645 and the plunger solenoid 45, respectively, based on a control signal received from the main control portion 603.

Figure 6:
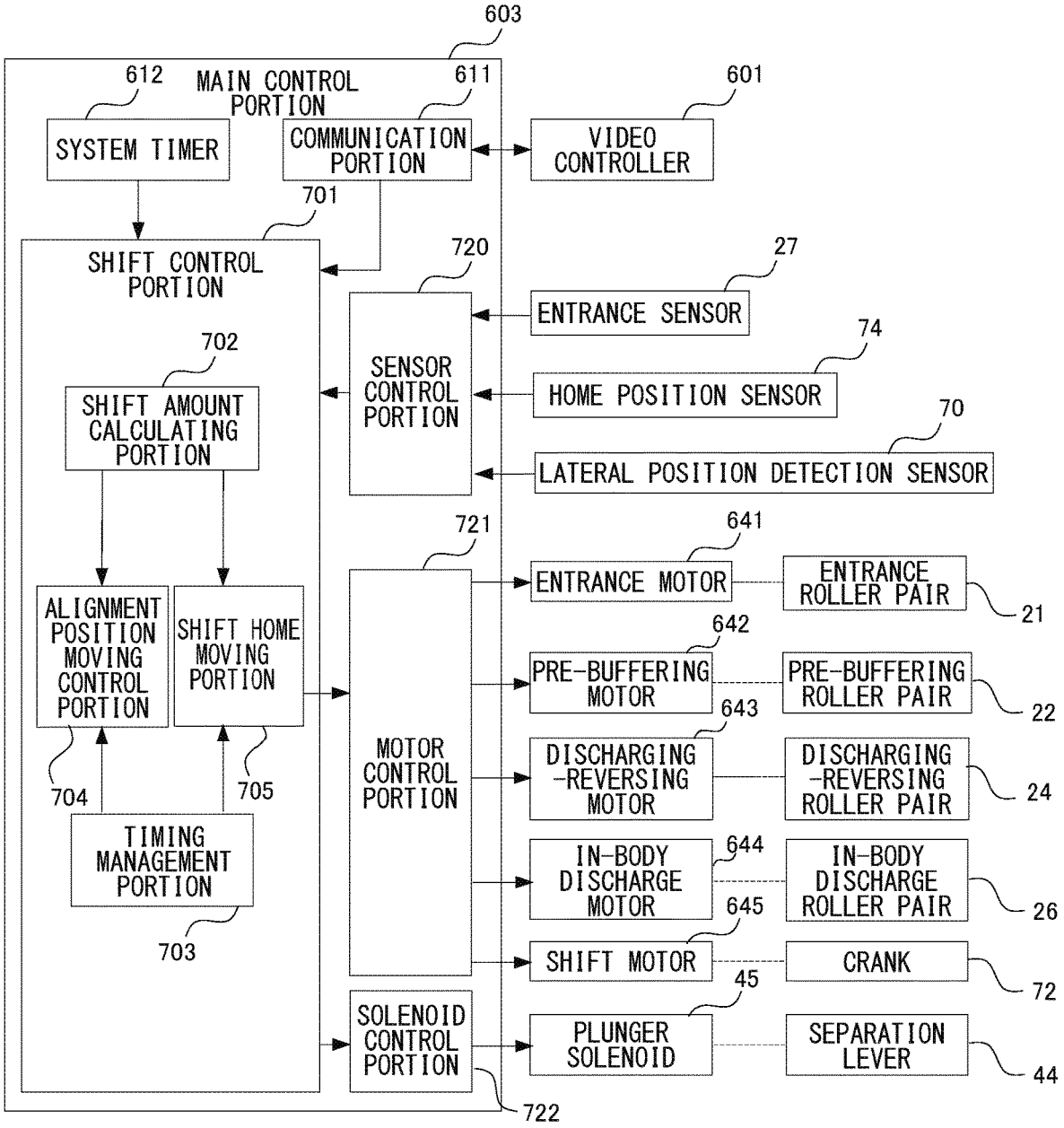
FIG. 6 is a control block diagram of the first exemplary embodiment.

Next, functional blocks of the present exemplary embodiment will be described with reference to FIG. 6. The main control portion 603 of the post-processing apparatus 4 is composed of the communication portion 611, the system timer 612, a shift control portion 701, a sensor control portion 720, a motor control portion 721 and a solenoid control portion 722. Each of these functions may be mounted in a form of software as a functional module of a program executed by the CPU 608 or may be mounted as hardware such as ASIC independent of the CPU 608.

The sensor control portion 720 has a function of inputting signals of the entrance sensor 27, the home position sensor 74 and the lateral position detection sensor 70 to a shift control portion 701. Based on an instruction of the sensor control portion 720, the shift control portion 701 controls a motor control portion 721 and a solenoid control portion 722. Based on an instruction of the shift control portion 701, a motor control portion 721 drives the entrance motor 641, the pre-buffering motor 642, the discharging-reversing motor 643, the in-body discharge motor 644, and the shift motor 645 and a solenoid control portion 722 drives the plunger solenoid 45.

Note that an object to be driven by the entrance motor 641 is the entrance roller pair 21, objects to be driven by the pre-buffering motor 642 are the pre-buffering roller pair 22 and an object to be driven by the discharging-reversing motor 643 is the discharging-reversing roller pair 24. An object to be driven by the in-body discharge motor 644 is the in-body discharge roller pair 26, an object to be driven by the shift motor 645 is a shift crank mechanism 72 and an object to be driven by the plunger solenoid 45 is a separation lever 44.

The shift control portion 701 is composed of a shift amount calculating portion 702, a timing management portion 703, an alignment position moving control portion 704 and a shift home moving portion 705.

The shift amount calculating portion 702 has a function of calculating a shift amount of shifting the sheet being conveyed based on width information of the sheet instructed from the video controller 601 and lateral position information of the sheet received from the sensor control portion 720. The shift amount calculating portion 702 also notifies the calculated shift amount to the alignment position moving control portion 704 and instructs a rotation direction of the motor to the shift home moving portion 705.

The timing management portion 703 has a function of notifying timing at which the shift operation should be executed to the alignment position moving control portion 704 based on signal information of the entrance sensor 27 received from the sensor control portion 720. The timing management portion 703 also has a function of notifying timing at which the shift conveyance mechanism 24A should be moved to the home position to the shift home moving portion 705.

The alignment position moving control portion 704 has a function of finding a driving amount of the motor from the shift amount, controlling each motor by using the motor control portion 721 and executing the shift operation by a necessary shift amount, in a case where the timing at which the shift move should be performed and the shift amount are notified.

The shift home moving portion 705 has a function of returning the shift conveyance mechanism 24A to the home position, in a case where timing at which a move to the home position should be made is notified. That is, the shift home moving portion 705 moves the shift conveyance mechanism 24A to the home position by controlling the motor control portion 721 and the solenoid control portion 722 in accordance to the rotation direction specified from the shift amount calculating portion 702. The shift home moving portion 705 also makes reference to the signal information of the home position sensor 74 received from the sensor control portion 720 in controlling the shift conveyance mechanism 24A.

Single-Sheet Alignment Control of Sheet to be Discharged to Upper Discharge Tray Next, an operation of the shift conveyance mechanism 24A in discharging the sheet to the upper discharge tray 25 serving as a first stacking portion of the present exemplary embodiment will be sequentially described with reference to FIGS. 7A through 8D.

Figure 7A:
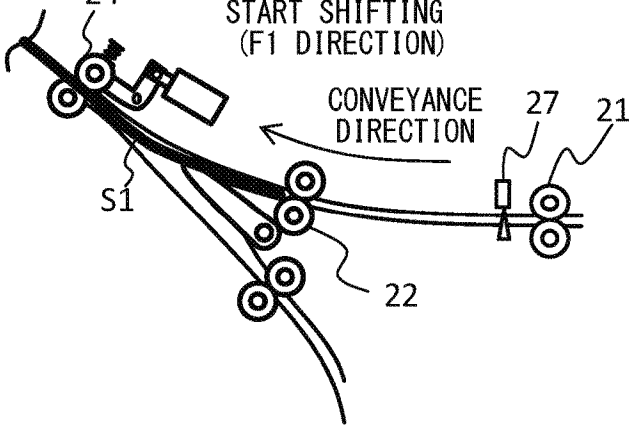
FIG. 7A is a section view schematically illustrating a conveyance operation in which an upper discharge tray is set as a discharge destination in the first exemplary embodiment.
Figure 8B:
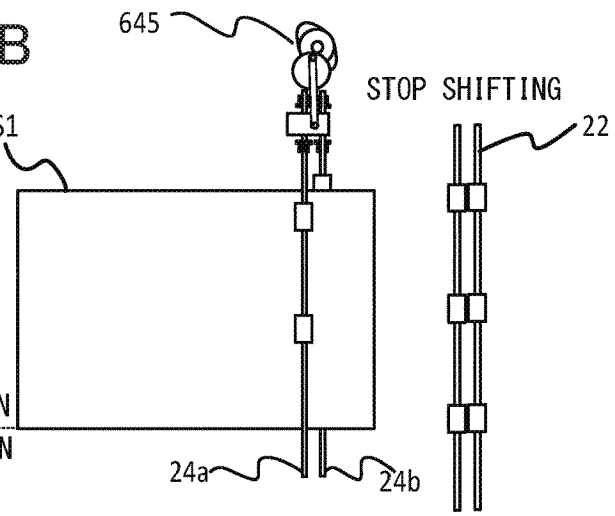
FIG. 8B is a plan view schematically illustrating the conveyance operation in the first exemplary embodiment.
Figure 8D:
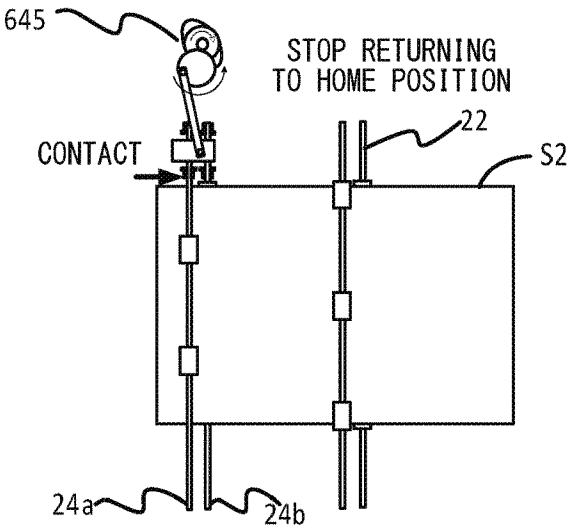
FIG. 8D is a plan view schematically illustrating the conveyance operation in the first exemplary embodiment.
Figure 8A:
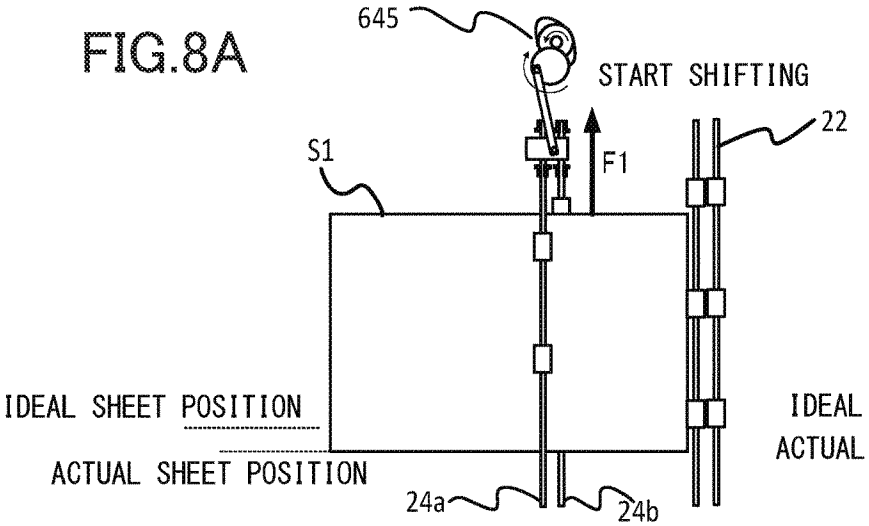
FIG. 8A is a plan view schematically illustrating the conveyance operation in which the upper discharge tray is set as the discharge destination in the first exemplary embodiment.

1. The shift conveyance mechanism 24A starts to shift the sheet S1 as illustrated in FIGS. 7A and 8A by driving the shift motor 645 at timing when a trailing edge of the sheet S1 conveyed from the entry path 81 to the discharging-reversing roller pair 24 passes through the pre-buffering roller pair 22. At this time, a shift direction and a shift amount are controlled so as to correct a deviation amount between an actual sheet position detected by the lateral position detection sensor 70 and an ideal sheet position, i.e., a target position of the shift operation, in discharging onto the upper discharge tray 25.

Figure 7B:
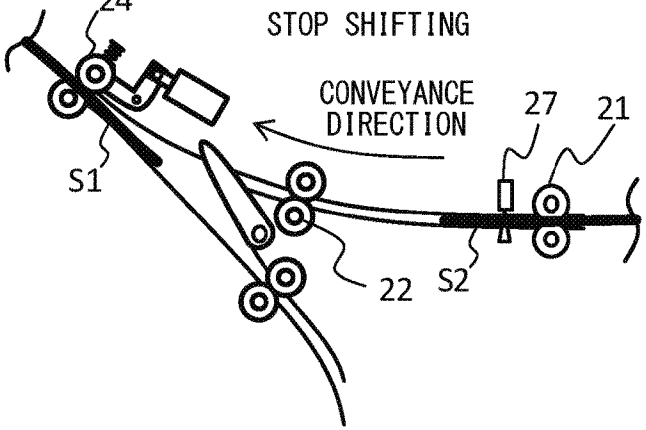
FIG. 7B is a section view schematically illustrating the conveyance operation in the first exemplary embodiment.

2. The shift motor 645 is stopped at timing when the deviation amount of the lateral position of the sheet S1 detected by the lateral position detection sensor 70 is corrected by shifting the discharging-reversing roller pair 24 as illustrated in FIGS. 7B and 8B. At this time, the conveyance of the sheet S1 by the discharging-reversing roller pair 24 is continued.

Figure 7C:
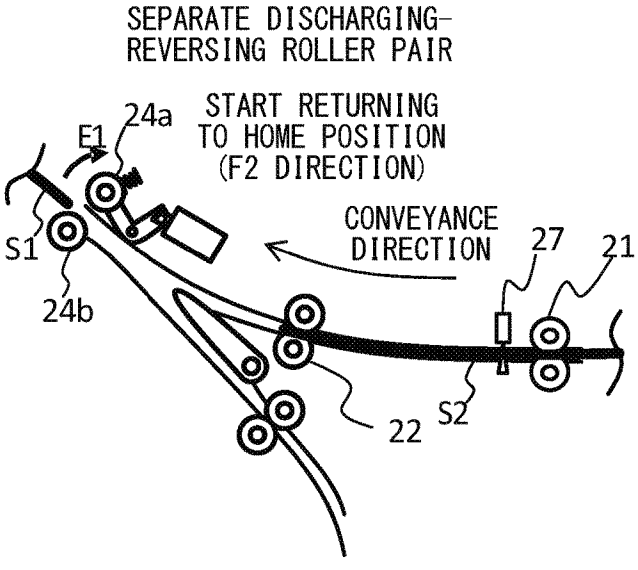
FIG. 7C is a section view schematically illustrating the conveyance operation in the first exemplary embodiment.
Figure 8C:
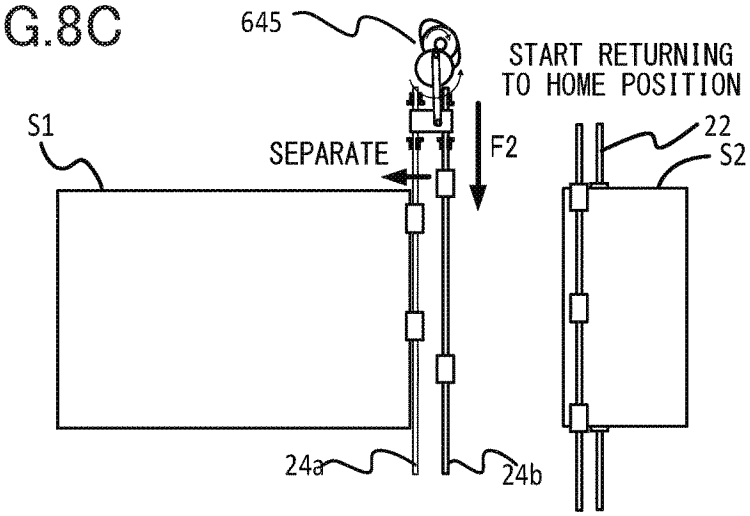
FIG. 8C is a plan view schematically illustrating the conveyance operation in the first exemplary embodiment.

3. By energizing the plunger solenoid 45 at timing when the trailing edge of the sheet S1 passes through the discharging-reversing roller pair 24, the reverse upper roller 24*a* is separated from the reverse lower roller 24*b* as illustrated in FIGS. 7C and 8C. Still further, the reverse upper roller 24*a* waits until the discharging-reversing roller pair 24 is separated, the shift conveyance mechanism 24A starts an operation of returning the discharging-reversing roller pair 24 to the home position by driving the shift motor 645 in a direction opposite to the shift operation in FIGS. 7A and 8A.

Figure 7D:
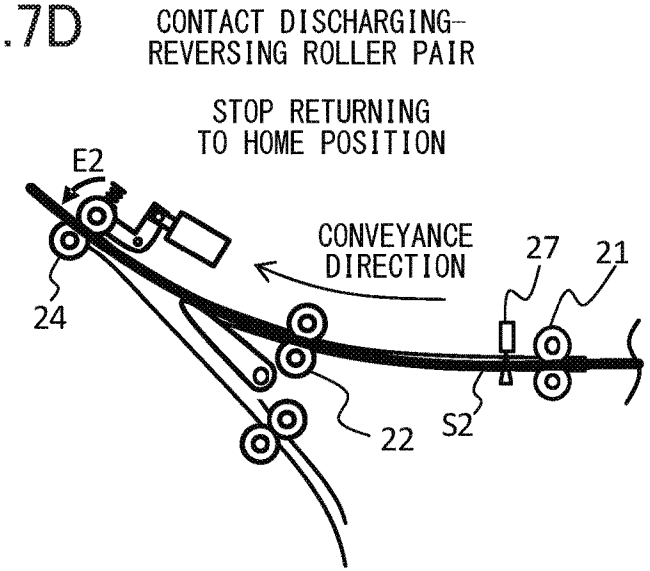
FIG. 7D is a section view schematically illustrating the conveyance operation in the first exemplary embodiment.

4. The shift motor 645 is stopped at timing when a signal of the home position sensor 74 indicates that the discharging-reversing roller pair 24 is located at the home position, and energizing of the plunger solenoid 45 is also stopped as illustrated in FIGS. 7D and 8D. Thereby, a next sheet S2 is nipped and conveyed by the discharging-reversing roller pair 24.

The shift conveyance mechanism 24A can execute the discharge operation of discharging the sheet onto the upper discharge tray 25 while shifting the sheet one by one to a predetermined target position, i.e., the single-sheet alignment control, continuously by repeating the above mentioned operations 1 to 4. Note that FIG. 8A illustrates the shift direction of the sheet S1 to be upward in FIG. 8A, the shift direction may be downward depending on an actual sheet position.

First Control Method of Single-Sheet Alignment Control

A control flow of the single-sheet alignment control in which the upper discharge tray 25 is set as a discharge destination, i.e., a first alignment control of the present exemplary embodiment, will be described with reference to FIGS. 9A through 10B. FIGS. 9A and 9B and 10A and 10B represent contents of the control executed by the shift amount calculating portion 702, the timing management portion 703, the alignment position moving control portion 704 and the shift home moving portion 705 constituting the shift control portion 701 (see FIG. 6).

Figure 9A:
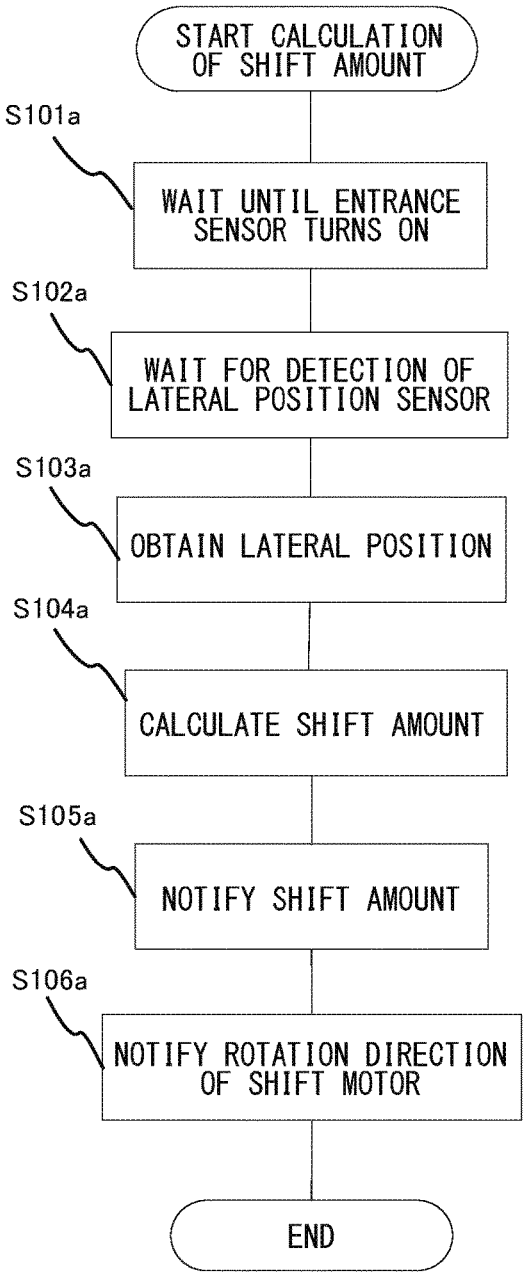
FIG. 9A is a control flow diagram of a part of single-sheet alignment control in which the upper discharge tray is set as the discharge destination according to the first exemplary embodiment.

FIG. 9A illustrates a control flow of the shift amount calculating portion 702. The shift amount calculating portion 702 starts at timing when a sheet width is notified from the video controller 601 and waits until the entrance sensor 27 detects a leading edge of the sheet passed from the image forming apparatus 1 to the post-processing apparatus 4 in Step S101*a*. Next, starting at the timing when the entrance sensor 27 detects the leading edge of the sheet, i.e., the sensor is turned ON, the shift amount calculating portion 702 waits until timing when the lateral position detection sensor 70 detects a lateral position of the sheet in Step S102*a* and obtains the lateral position of the detected sheet in Step S103*a*. Then, the shift amount calculating portion 702 calculates a shift amount from the obtained lateral position of the sheet and sheet width information specified from the video controller 601 in Step S104*a*. Then, the shift amount calculating portion 702 notifies the calculated shift amount to the alignment position moving control portion 704 in Step S105*a* and notifies a rotation direction of the shift motor 645 in returning to the home position to the shift home moving portion 705 in Step S106*a*.

Figure 9B:
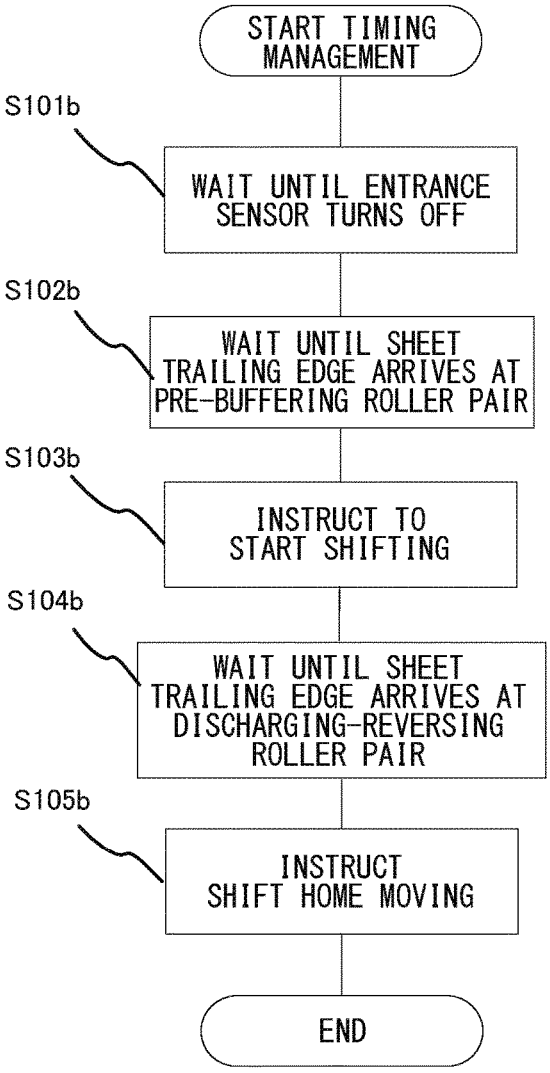
FIG. 9B is a control flow diagram of another part of the single-sheet alignment control according to the first exemplary embodiment.

FIG. 9B illustrates a control flow of the timing management portion 703. The timing management portion 703 starts at timing when a leading edge of the sheet arrives at the entrance sensor 27 and waits until the entrance sensor 27 detects the trailing edge of the sheet passed from the image forming apparatus 1 to the post-processing apparatus 4 in Step S101*b*. Next, with the timing when the entrance sensor 27 detects the trailing edge of the sheet, i.e., the sensor is turned OFF, as a starting-point, the timing management portion 703 waits until the trailing edge of the sheet arrives at the pre-buffering roller pair 22 in Step S102*b*. The timing management portion 703 instructs the alignment position moving control portion 704 to start the shift at the timing when the trailing edge of the sheet arrives at the pre-buffering roller pair 22 in Step S103*b* and waits further until the trailing edge of the sheet arrives at the discharging-reversing roller pair 24 in Step S104*b*. At timing of a lapse of that time, the timing management portion 703 instructs the shift home moving portion 705 to move the shift to the home position in Step S105*b*.

Figure 10A:
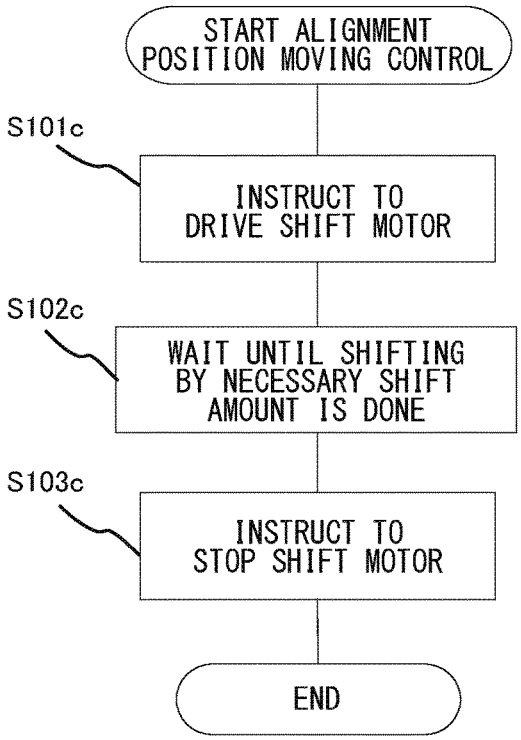
FIG. 10A is a control flow diagram of still another part of the single-sheet alignment control in the first exemplary embodiment.

FIG. 10A illustrates a control flow of the alignment position moving control portion 704. The alignment position moving control portion 704 starts at the timing when the alignment position moving control portion 704 is instructed from the timing management portion 703 to start the shift and instructs the shift motor 645 to drive at first in Step S101*c*. Still further, the alignment position moving control portion 704 monitors a driving amount of the shift motor 645 and waits until a move amount of the discharging-reversing roller pair 24 reaches a shift amount instructed by the shift amount calculating portion 702 in Step S102*c*. The alignment position moving control portion 704 instructs the shift motor 645 to stop at the timing when the move amount of the discharging-reversing roller pair 24 reaches the shift amount specified by the shift amount calculating portion 702 in Step S103*c*.

Figure 10B:
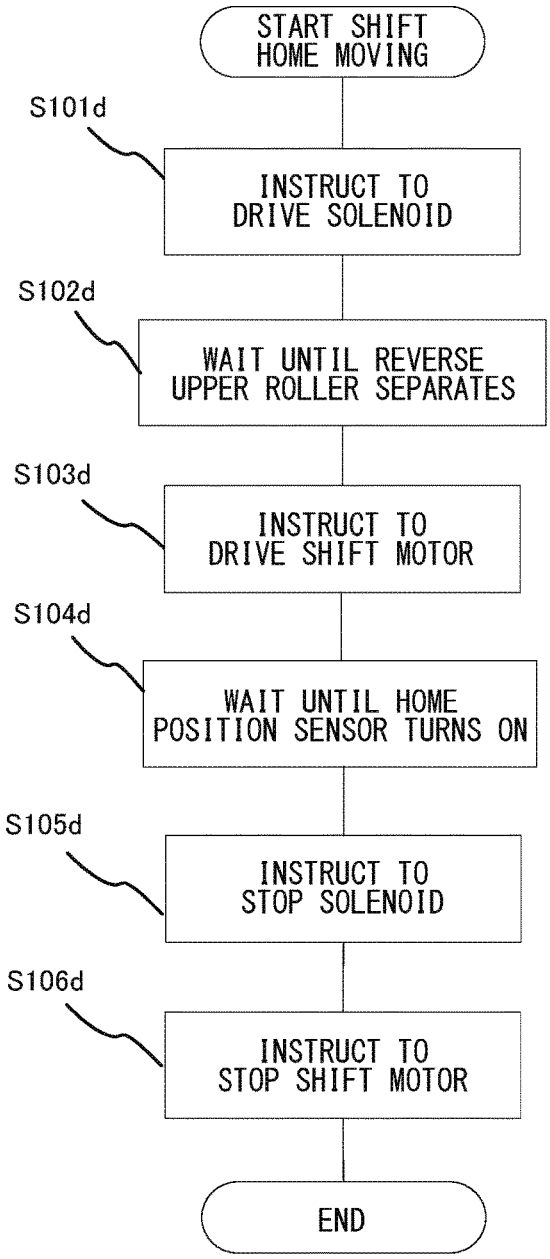
FIG. 10B is a control flow diagram of still another part of the single-sheet alignment control in the first exemplary embodiment.

FIG. 10B illustrates a control flow of the shift home moving portion 705. The shift home moving portion 705 starts at the timing when the move to the home position is instructed from the timing management portion 703. The shift home moving portion 705 instructs to energize the plunger solenoid 45 to execute the separating operation of the discharging-reversing roller pair 24 in Step S101*d*. Then, the shift home moving portion 705 waits until the reverse upper roller 24*a* is separated from the reverse lower roller 24*b* in Step S102*d* and instructs the shift motor 645 to drive in the direction notified to the shift amount calculating portion 702 in Step S103*d*. After that, the shift home moving portion 705 waits until the signal of the home position sensor 74 indicates that the discharging-reversing roller pair 24 has arrived at the home position in Step S104*d*. Then, the shift home moving portion 705 stops the plunger solenoid 45 at the timing when the discharging-reversing roller pair 24 has arrived at the home position in Step S105*d* and stops driving the shift motor 645 in Step S106*d*.

Single-Sheet Alignment Control of Sheet to be Discharged to Lower Discharge Tray Next, an operation of the shift conveyance mechanism 24A in discharging the sheet to the lower discharge tray 37 serving as a second stacking portion of the present exemplary embodiment will be sequentially described with reference to FIGS. 11A through 11F.

Figure 11A:
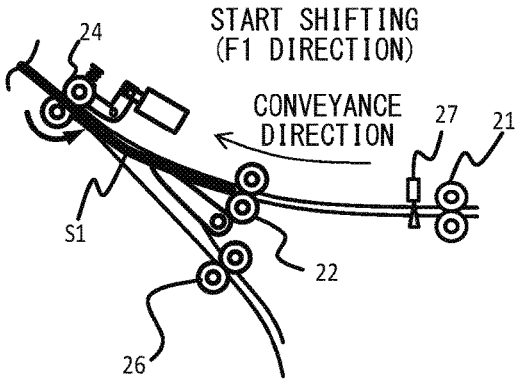
FIG. 11A is a section view schematically illustrating a conveyance operation in which a lower discharge tray is set as a discharge destination in the first exemplary embodiment.

1. A shift operation of the sheet S1 is started as illustrated in FIG. 11A by driving the shift motor 645 at the timing when a trailing edge of the sheet S1 conveyed from the entry path 81 to the discharging-reversing roller pair 24 passes through the pre-buffering roller pair 22. At this time, a shift direction and a shift amount are controlled so as to correct a deviation amount between an actual sheet position detected by the lateral position detection sensor 70 and an ideal sheet position, i.e., a target position of the shift operation, in discharging onto the lower discharge tray 37.

Figure 11B:
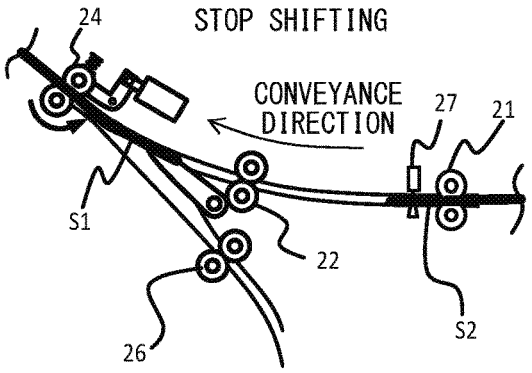
FIG. 11B is a section view schematically illustrating the conveyance operation in the first exemplary embodiment.

2. The shift motor 645 is stopped at timing when the deviation amount of the lateral position of the sheet S1 detected by the lateral position detection sensor 70 is corrected by shifting the discharging-reversing roller pair 24 as illustrated in FIG. 11B. At this time, the conveyance of the sheet S1 by the discharging-reversing roller pair 24 is continued.

Figure 11C:
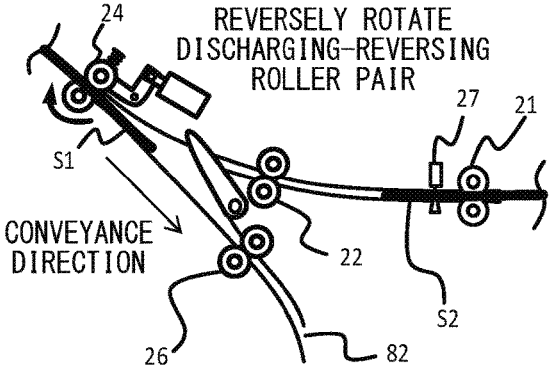
FIG. 11C is a section view schematically illustrating the conveyance operation in the first exemplary embodiment.

3. The discharging-reversing motor 643 is driven so as to rotate reversely at timing when the trailing edge of the sheet passes through the non-return flap 23 as illustrated in FIG. 11C. Thereby, the sheet S1 being shifted to a target position is sent to the in-body discharge path 82.

Figure 11D:
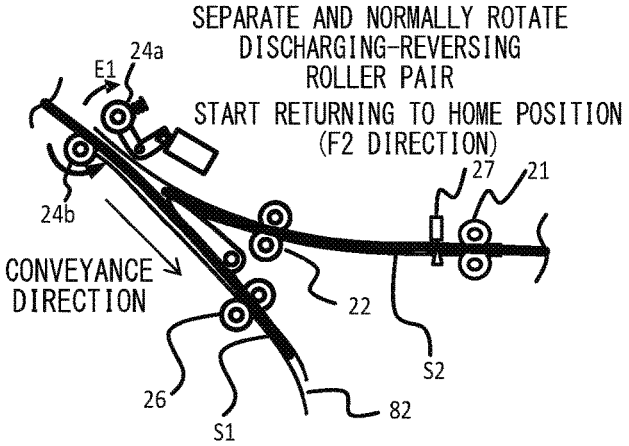
FIG. 11D is a section view schematically illustrating the conveyance operation in the first exemplary embodiment.

4. The discharging-reversing motor 643 is normally driven at timing when the leading edge of the sheet arrives at the in-body discharge roller pair 26, and the plunger solenoid 45 is energized to separate the reverse upper roller 24*a* from the reverse lower roller 24*b* as illustrated in FIG. 11D. Still further, waiting until the discharging-reversing roller pair 24 is separated, the shift conveyance mechanism 24A starts an operation of returning the discharging-reversing roller pair 24 to the home position by driving the shift motor 645 in a direction opposite to the shift operation in FIG. 11A.

Figure 11E:
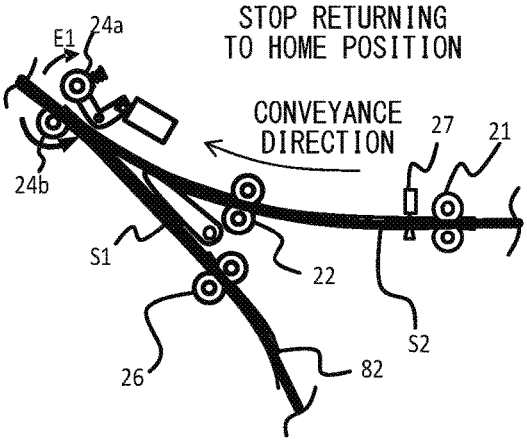
FIG. 11E is a section view schematically illustrating the conveyance operation in the first exemplary embodiment.

5. The shift motor 645 is stopped at timing when a signal of the home position sensor 74 indicates that the discharging-reversing roller pair 24 is located at the home position as illustrated in FIG. 11E. Thereby, a next sheet S2 is nipped and conveyed by the discharging-reversing roller pair 24. Differing from the case of discharging the sheet to the upper discharge tray 25 as illustrated in FIG. 7D, the shift conveyance mechanism 24A keeps the separation state without contacting the discharging-reversing roller pair 24 in this stage so as not to hamper the conveyance of the preceding sheet S1.

Figure 11F:
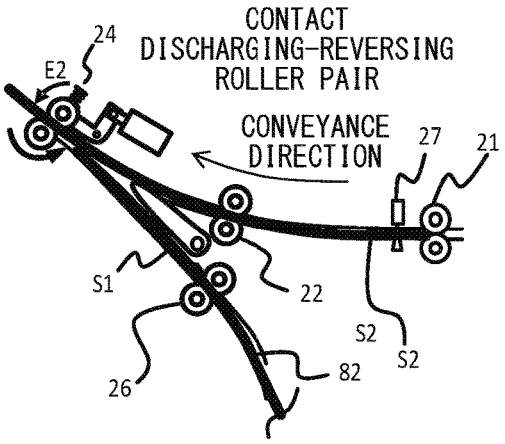
FIG. 11F is a section view schematically illustrating the conveyance operation in the first exemplary embodiment.

6. Energizing of the plunger solenoid 45 is stopped at timing when the trailing edge of the sheet in the forward conveyance direction of the in-body discharge path 82 passes through the discharging-reversing roller pair 24 as illustrated in FIG. 11F. Thereby, a next sheet S2 is nipped and conveyed by the discharging-reversing roller pair 24.

The shift conveyance mechanism 24A can execute the discharge operation of discharging the sheet onto the lower discharge tray 37 while shifting the sheet one by one to the predetermined target position, i.e., the single-sheet alignment control, continuously by repeating the above mentioned operations 1 to 6.

Second Control Method of Single-Sheet Alignment Control

A control flow of single-sheet alignment control in which the lower discharge tray 37 is set as a discharge destination, i.e., a second alignment control of the present exemplary embodiment, will be described with reference to FIGS. 12A through 13B. FIGS. 12A and 12B and 13A and 13B represent contents of the control executed by the shift amount calculating portion 702, the timing management portion 703, the alignment position moving control portion 704 and the shift home moving portion 705 constituting the shift control portion 701 (see FIG. 6).

Figure 12A:
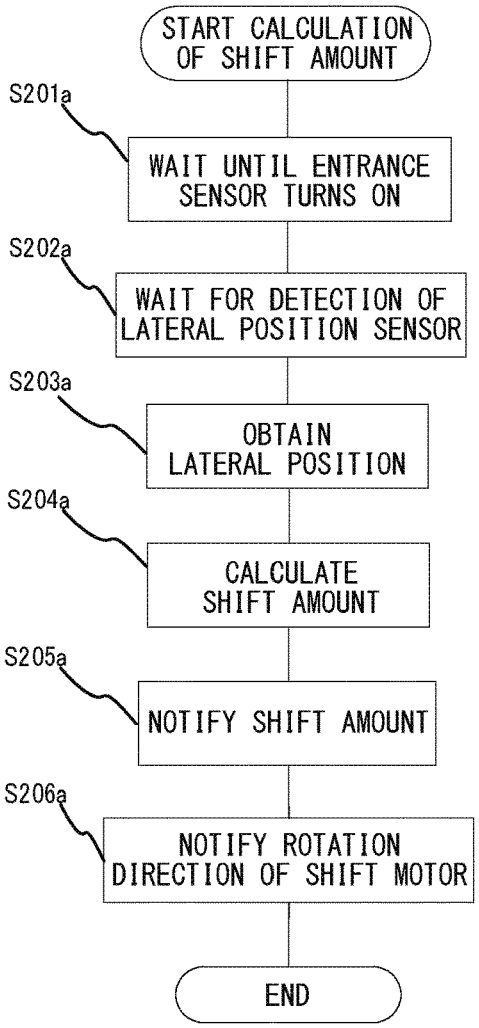
FIG. 12A is a control flow diagram of a part of a single-sheet alignment control for calculating a shift amount in which the lower discharge tray is set as the discharge destination.

FIG. 12A illustrates a control flow of the shift amount calculating portion 702 and is similar to the single-sheet alignment control in which the upper discharge tray 25 is the discharge destination in FIG. 9A. That is, because the contents of the respective steps of Step S201*a* through Step S206*a* are the same with Step S101*a* through Step S106*a* in FIG. 9A, so that their description will be omitted here.

Figure 12B:
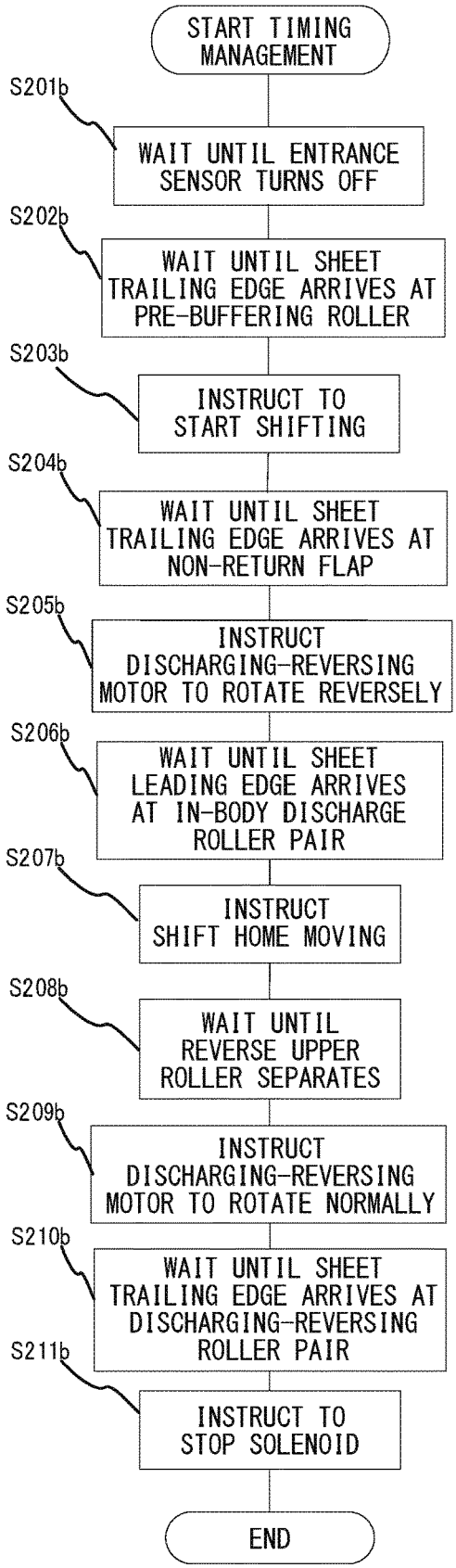
FIG. 12B is a control flow diagram of another part of the single-sheet alignment control in the first exemplary embodiment.

FIG. 12B illustrates a control flow of the timing management portion 703. The timing management portion 703 starts at timing when the leading edge of the sheet arrives at the entrance sensor 27 and waits until the entrance sensor 27 detects the trailing edge of the sheet passed from the image forming apparatus 1 to the post-processing apparatus 4 in Step S201*b*. Next, with the timing when the entrance sensor 27 detects the trailing edge of the sheet, i.e., the sensor is turned OFF, as a starting-point, the timing management portion 703 waits until timing when the trailing edge of the sheet arrives at the pre-buffering roller pair 22 in Step S202*b*. The timing management portion 703 instructs the alignment position moving control portion 704 to start the shift operation at the timing when the trailing edge of the sheet arrives at the pre-buffering roller pair 22 in Step S203*b* and waits until the trailing edge of the sheet arrives at the non-return flap 23 in Step S204*b*. The timing management portion 703 instructs the discharging-reversing motor 643 to rotate reversely at the timing when the trailing edge of the sheet arrives at the non-return flap 23 in Step S205*b* and waits until the leading edge of the sheet arrives at the in-body discharge roller pair 26 in Step S206*b*. At the timing when the leading edge of the sheet arrives at the in-body discharge roller pair 26, the timing management portion 703 instructs the shift home moving portion 705 to move to the home position in the shift in Step S207*b*. Then, the timing management portion 703 waits until the reverse upper roller 24*a* is separated by the process of the shift home moving portion 705 in Step S208*b*, the timing management portion 703 instructs the discharging-reversing motor 643 to normally rotate in Step S209*b*. After that, the timing management portion 703 waits until the trailing edge of the sheet in the forward conveyance direction of the in-body discharge path 82 arrives at the discharging-reversing roller pair in Step S210*b*, the timing management portion 703 instructs to stop energization of the plunger solenoid 45 in Step S211*b*.

Figure 13A:
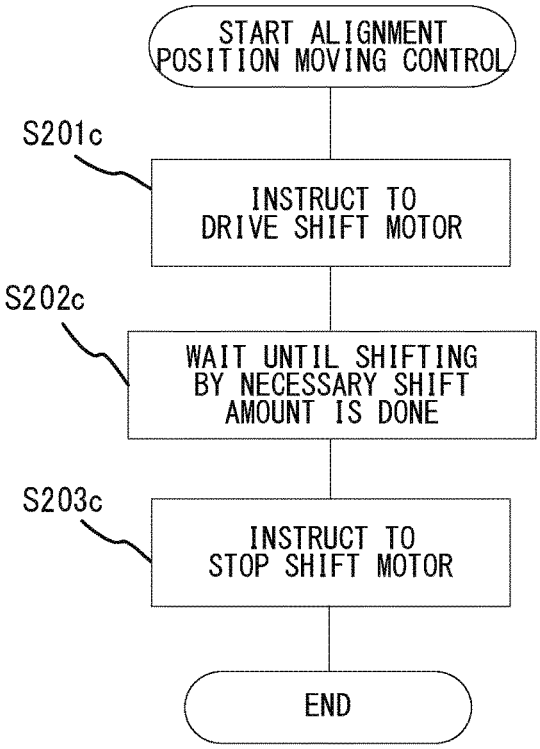
FIG. 13A is a control flow diagram of still another part of the single-sheet alignment control in the first exemplary embodiment.

FIG. 13A illustrates a control flow of the alignment position moving control portion 704 and is similar to the single-sheet alignment control in which the upper discharge tray 25 is set as the discharge destination in FIG. 10A. That is, because the contents of the respective steps of Step S201*c* through Step S203*c* are the same with Step S101*c* through Step S103*c* in FIG. 10A, so that their description will be omitted here.

Figure 13B:
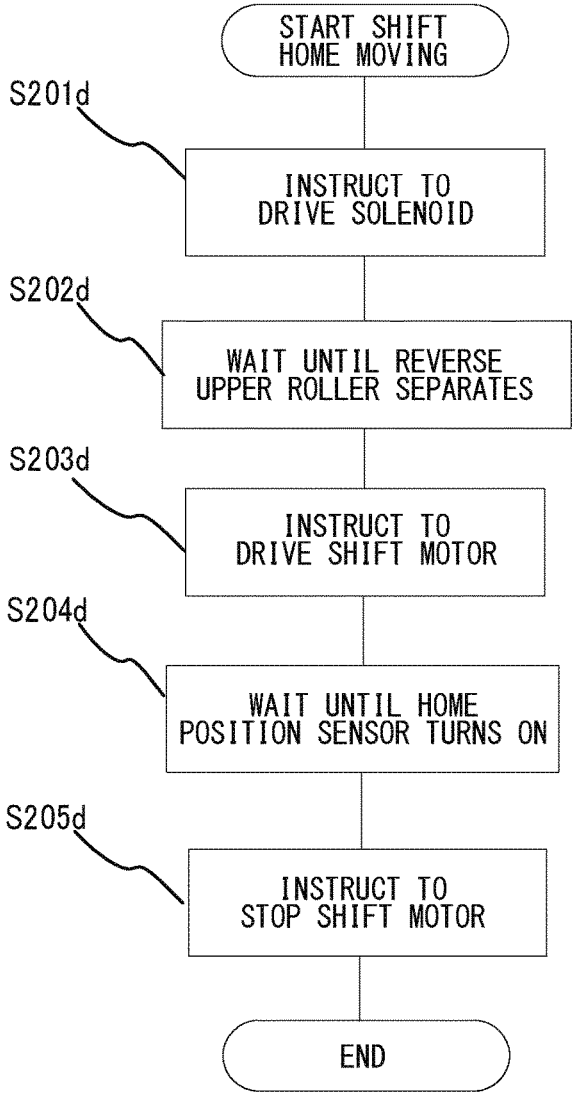
FIG. 13B is a control flow diagram of still another part of the single-sheet alignment control in the first exemplary embodiment.

FIG. 13B illustrates a control flow of the shift home moving portion 705. The shift home moving portion 705 starts at the timing when the move to the home position is instructed from the timing management portion 703 and instructs energization of the plunger solenoid 45 to execute the separate operation of the discharging-reversing roller pair 24 in Step S201*d*. Then, the shift home moving portion 705 waits until the reverse upper roller 24*a* is separated from the reverse lower roller 24*b* in Step S202*d* and instructs the shift motor 645 to drive in the direction notified by the shift amount calculating portion 702 in Step S203*d*. After that, the shift home moving portion 705 waits until the signal of the home position sensor 74 indicates that the discharging-reversing roller pair 24 has arrived at the home position in Step S204*d*. Then, the shift home moving portion 705 stops driving the shift motor 645 at the timing when the signal of the home position sensor 74 indicates that the home position is detected in Step S205*d*.

Binding Processing Portion

Figure 24A:
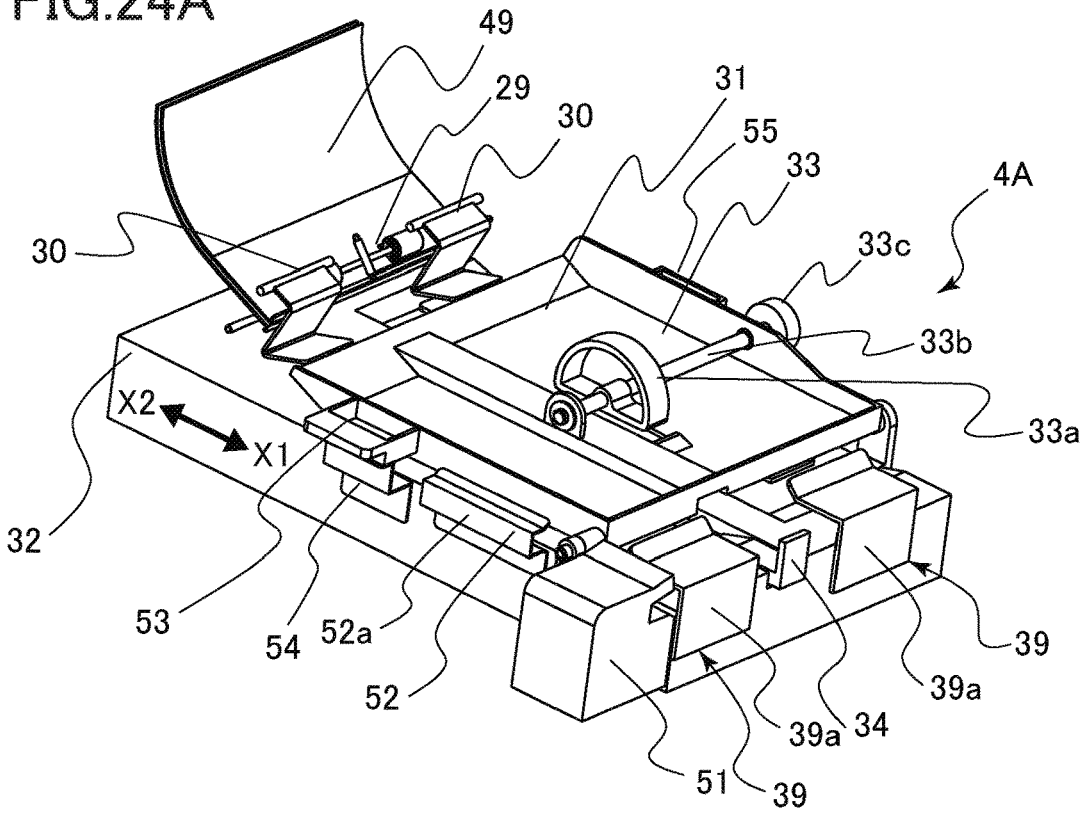
FIG. 24A is a perspective view illustrating a binding processing portion of the embodiments in the present disclosure.

The sheet sent to the in-body discharge path 82 while being shifted by the shift conveyance mechanism 24A is discharged onto the lower discharge tray 37 via the binding processing portion 4A. Then, the binding processing portion 4A will be described below. FIG. 24A is a perspective view illustrating the binding processing portion 4A and FIG. 24B is a perspective view illustrating the binding processing portion 4A in which a partial member, i.e., an intermediate upper guide 31, is opened.

Figure 24B:
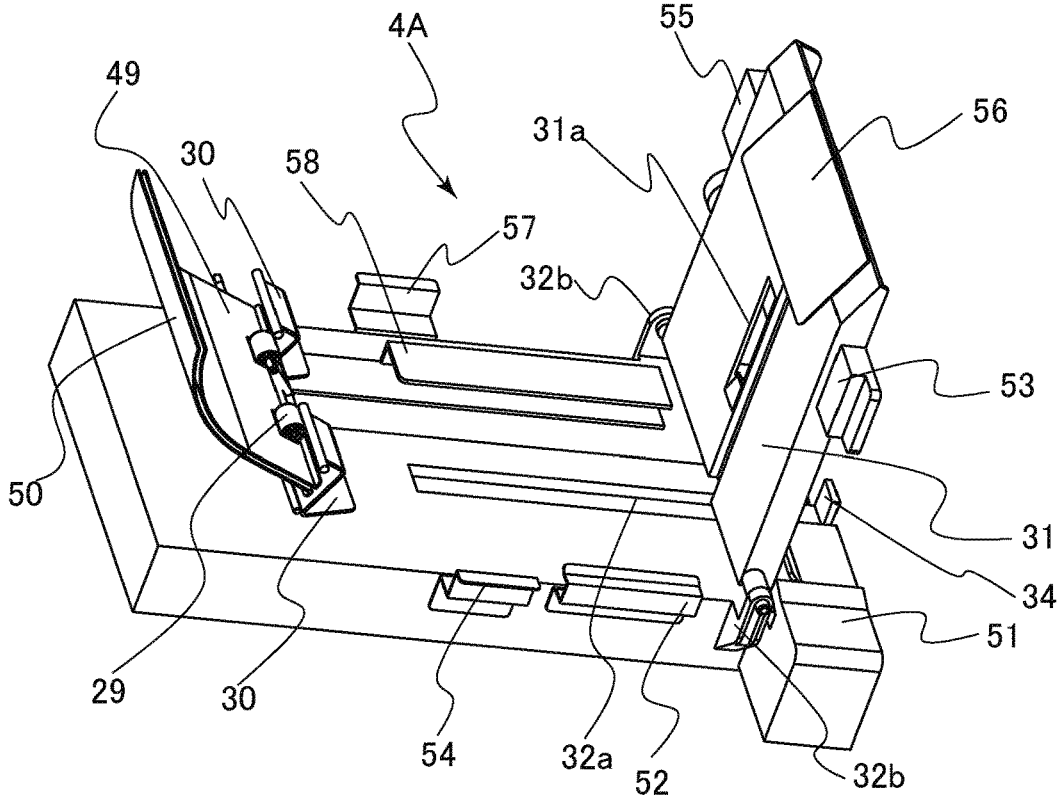
FIG. 24B is a perspective view illustrating the binding processing portion in a state in which a part thereof is opened.

As illustrated in schematic diagrams in FIGS. 24A and 24B as well as in FIG. 1, the binding processing portion 4A includes a stapler 51, the intermediate upper guide 31, the intermediate lower guide 32, a longitudinal alignment standard plate 39, a longitudinal alignment roller 33, a bundle discharge guide 34 and a guide driving portion 35. The binding processing portion 4A performs a binding process on sheets discharged out of the in-body discharge path 82 and stacked into an intermediate stacking portion by the stapler 51 to form a bound sheet bundle.

The intermediate upper and lower guides 31 and 32 constitute the intermediate stacking portion onto which the sheet to be processed is stacked. A bundle pressing flag 30 is pivotably provided downstream of the kick-out roller pair 29. A lower surface of the bundle pressing flag 30 presses a trailing edge portion of a preceding sheet discharged formerly onto the intermediate stacking portion to let a leading edge of a succeeding sheet discharged later by the kick-out roller pair 29 pass above the leading edge of the preceding sheet. That is, the bundle pressing flag 30 functions as a member preventing a collision of the sheets by moving down the trailing edge portion of the sheet discharged out of the kick-out roller pair 29. The lower surface of the bundle pressing flag 30 is provided in a range of a sheet width direction such that the lower surface can press both sheet widthwise end portions of each size that can be processed by the binding processing portion 4A.

The longitudinal alignment roller 33 serving as a moving member of the present exemplary embodiment is disposed above the intermediate lower guide 32. The longitudinal alignment roller 33 is molded with elastic material such as synthetic rubber or elastomer resin and includes a roller portion 33*a* modified such that an outer circumferential surface has predetermined frictional coefficient. The roller portion 33*a* is supported by a shaft portion 33*b* rotatably supported by the intermediate upper guide 31 and is driven to rotate intermittently per one rotation by a drive transmitting unit including a gear portion 33*c*. The roller portion 33*a* which is the outer circumferential portion of the longitudinal alignment roller 33 is non-circular when viewed in an axial direction of the shaft portion 33*b*. The longitudinal alignment roller 33 is kept at such a rotation angle that the roller portion 33*a* is not exposed out of the intermediate upper guide 31 in a standby state before the sheet is discharged onto the intermediate stacking portion. Still further, while the longitudinal alignment roller 33 makes one rotation, the roller portion 33*a* is temporarily exposed out of an opening 31*a* provided on the intermediate upper guide 31 and comes into contact with an upper surface of an uppermost sheet stacked on the intermediate lower guide 32 to apply a conveyance force. A contact pressure to the sheet of the longitudinal alignment roller 33 is adjusted such that the longitudinal alignment roller 33 slips after the sheet is abutted against the longitudinal alignment standard plate 39.

A pressure guide 56 which is a flexible sheet member is disposed in the intermediate stacking portion. The pressure guide 56 is disposed so as to abut with the intermediate lower guide 32 to press the upper surface of the sheet stacked onto the intermediate stacking portion with a predetermined pressurizing force.

The longitudinal alignment standard plate 39 serving as a regulating member of the present exemplary embodiment is provided downstream of the longitudinal alignment roller 33 in terms of the sheet discharge direction of the kick-out roller pair 29. The longitudinal alignment standard plate 39 includes a standard wall 39*a* projecting upward from an upper surface of the intermediate lower guide 32 and serving as a regulating portion that abuts with an end portion of the sheet. The longitudinal alignment standard plate 39 of the present exemplary embodiment is provided at two places, i.e., at both sides in a sheet width direction orthogonal to the sheet discharge direction.

A direction in which the sheet discharged out of the kick-out roller pair 29 moves toward the longitudinal alignment standard plate 39 will be referred to as a "longitudinal alignment direction X1" hereinafter. The longitudinal alignment direction X1 is a direction along the forward conveyance direction in the in-body discharge path 82 and is also a direction in which the longitudinal alignment roller 33 moves the sheet toward the longitudinal alignment standard plate 39. Still further, a direction opposite to the longitudinal alignment direction X1, i.e., a direction in which the sheet bundle is discharged out of the binding processing portion 4A, will be referred to as a "bundle discharge direction X2" hereinafter.

The stapler 51 performs a binding process to a plurality of sheets, stacked onto the intermediate stacking portion and aligned in terms of the longitudinal alignment direction X1 and the sheet width direction, at a predetermined position. The stapler 51 of the present exemplary embodiment is provided on a same side with the lateral alignment standard plate 52 in terms of the sheet width direction so as to be movable in the longitudinal alignment direction X1 and the bundle discharge direction X2. Still further, the intermediate lower guide 32 has an area that enables to stack an A4-sized sheet conveyed in a long edge feed direction, i.e., in a conveyance direction in which the longitudinal alignment direction X1 is a long edge direction and the sheet width direction is a short edge direction. Accordingly, the stapler 51 can perform not only a corner binding operation by which a corner of a sheet bundle stacked on the intermediate stacking portion is bound but also a long edge binding operation of binding a plurality of positions along one of the long edges of the sheet bundle while moving with respect to the sheet bundle. Note that the stapler 51 is not limited to what binds the sheets by using a staple, and a staple-less binding system that crimps sheets by nipping the sheets between concave-convex surfaces or that cuts and bends part of the sheets into a shape of U may be used.

A bundle discharge guide 34 serving as a pushing member for pushing the processed sheets out of the intermediate stacking portion is provided between the two longitudinal alignment standard plates 39. The bundle discharge guide 34 is attached to the guide driving portion 35 (see FIG. 1) and is movable in the bundle discharge direction X2, i.e., in a pushing direction, and in the longitudinal alignment direction X1. A slide groove 32*a* for guiding the move of the bundle discharge guide 34 is formed on the intermediate lower guide 32 as illustrated in FIG. 24B.

A lateral alignment standard plate 52 is fixed to the intermediate lower guide 32, and a lateral alignment jogger 58 is provided movably in the sheet width direction with respect to the lateral alignment standard plate 52. The lateral alignment standard plate 52 includes a standard wall 52*a* projecting upward from the upper surface of the intermediate lower guide 32 and extending along the longitudinal alignment direction X1, and faces the lateral alignment jogger 58 in the sheet width direction.

The intermediate upper guide 31 is pivotably, i.e., openably, supported with respect to the intermediate lower guide 32 centering on a fulcrum portion 32*b* of the intermediate lower guide 32. Abutment plates 54 and 57 position the intermediate upper guide 31 with respect to the intermediate lower guide 32 by abutting respectively with an opening/closing handle 53 and a fixing plate 55 of the intermediate upper guide 31. The abutment plates 54 and 57 are formed of magnetizable metal such as iron, and the opening/closing handle 53 and the fixing plate 55 contain magnet and regulate move of the intermediate upper guide 31 by a magnetic force. The opening/closing handle 53 is provided at a position accessible when an opening cover provided at a front surface of a casing of the post-processing apparatus 4 is opened for example. Therefore, in a case where a sheet jams in the binding processing portion 4A, a user can remove the jammed sheet by holding, after opening the opening cover, the opening/closing handle 53 and opening the intermediate upper guide 31.

Note that instead of the fixing unit that uses the magnet, it is also possible to adopt a snap-fit mechanism in which a hook formed of a resin material is provided on one of the intermediate upper and lower guides 31 and 32 and in which a concave portion engaging with the hook is provided on the other guide. As an example of the other fixing unit, it is possible to regulate relative moves of the intermediate upper and lower guides 31 and 32 by providing an axial projection, i.e., a joggle, on one of the intermediate upper and lower guides 31 and 32 and by providing a hook engaging with the projection on the other guide.

The binding processing portion 4A executes the following operation in performing the binding process. The sheet passed from the image forming apparatus 1 to the post-processing apparatus 4 is conveyed to the binding processing portion 4A through the in-body discharge path 82 while being shifted by the shift conveyance mechanism 24A. The sheet discharged onto the intermediate lower guide 32 by the kick-out roller pair 29 is caused to abut against the longitudinal alignment standard plate 39 in the longitudinal alignment direction X1 by the longitudinal alignment roller 33 to be longitudinally aligned and is caused to abut against the lateral alignment standard plate 52 by the lateral alignment jogger 58 to be laterally aligned. If a certain number of sheets constituting one sheet bundle is stacked and is aligned in the binding processing portion 4A, the stapler 51 binds a predetermined position of the sheet bundle. Then, a bundle discharge guide 34 pushes out the sheet bundle in the bundle discharge direction X2 to deliver the sheet bundle to a bundle discharge roller 36 via a second discharge path 84. The bundle discharge roller 36 nips and conveys the sheet bundle out of the casing of the post-processing apparatus 4 and discharges onto the lower discharge tray 37.

Meanwhile, it is also possible to discharge the sheet sent to the binding processing portion 4A through the in-body discharge path 82 to the lower discharge tray 37 without executing the binding process. In this case, the bundle discharge guide 34 may be moved to push the sheet out to the second discharge path 84 every time when the sheet is discharged to the intermediate lower guide 32 or may push the certain number of sheets out the second discharge path 84 after waiting until the certain number of sheets is stacked. In either case, the sheet is discharged onto the lower discharge tray 37 at the position shifted by the shift conveyance mechanism 24A except of positional deviation of a sheet caused in a downstream conveyance process by the discharging-reversing roller pair 24. Accordingly, it is also possible to discharge the sheet to the position which cannot be aligned by a one-side moving method of using the lateral alignment jogger 58 and the lateral alignment standard plate 52 described above.

Summary of First Exemplary Embodiment

As described above, according to the first exemplary embodiment, the shift operation of sheets discharged out to a plurality of discharge destinations can be performed by one discharge unit, i.e., the shift conveyance mechanism 24A, so that the configuration of the post-processing apparatus 4 can be simplified and thus can reduce costs.

Still further, because the sheet shifted by the shift conveyance mechanism 24A is delivered to the binding processing portion 4A, it is possible to control a discharge position of the sheet to be discharged onto the lower discharge tray 37 without performing the binding process in the binding processing portion 4A. Still further, as compared to a case where a sheet not aligned by the shift operation is delivered to the binding processing portion 4A, it is possible to suppress dispersion of a widthwise position of the sheet arriving at the binding processing portion 4A. Due to that, it is possible to set a moving width in the widthwise alignment operation, i.e., the lateral alignment operation, by the lateral alignment jogger 58 to be small. Or, it is possible to assure a widthwise alignment even if frequency of the lateral alignment operation is reduced, thus contributing to an improvement of productivity of the post-processing apparatus.

Second Exemplary Embodiment

A configuration of a post-processing apparatus of a second exemplary embodiment will be described. The present exemplary embodiment is carried out in performing a buffering operation of buffering sheets discharged out of the image forming apparatus 1 during a processing waiting period of a preceding sheet bundle by using the shift conveyance mechanism 24A in a case of forming a plurality of sheet bundles by performing the binding process in the binding processing portion 4A. Still further, in performing the buffering operation, a shift operation, i.e., a plural-sheet alignment control, of aligning widthwise positions among the plurality of sheets to be buffered is executed. Note that component parts having the same configurations and same operations with those of the first exemplary embodiment such as the mechanical configuration of the post-processing apparatus 4 will be denoted by the common reference signs and their description will be omitted here.

Buffering Operation Including Plural-Sheet Alignment Control

An outline of the buffering operation including the plural-sheet alignment control will be sequentially described with reference to FIGS. 14A through 17D. Note that reference signs of sheets "S1", "S2" and "S3" within the drawings indicate that the sheets are passed from the image forming apparatus 1 to the post-processing apparatus 4 in this order. Still further, the two sheets S1 and S2 are described as what are overlaid by the buffering operation here.

Figure 14A:
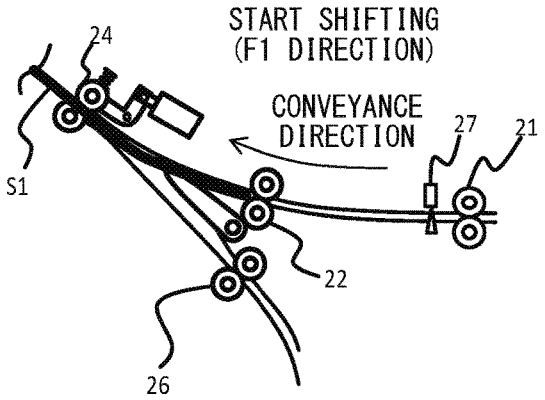
FIG. 14A is a section view schematically illustrating a phase of a conveyance operation including a buffering operation in a second exemplary embodiment.
Figure 14B:
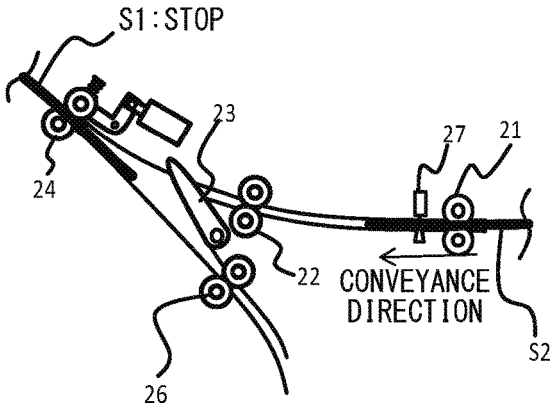
FIG. 14B is a section view schematically illustrating a next phase of the conveyance operation in the second exemplary embodiment.
Figure 14C:
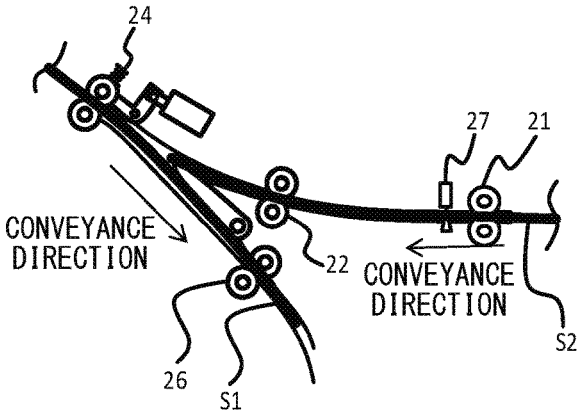
FIG. 14C is a section view schematically illustrating a further phase of the conveyance operation in the second exemplary embodiment.
Figure 14D:
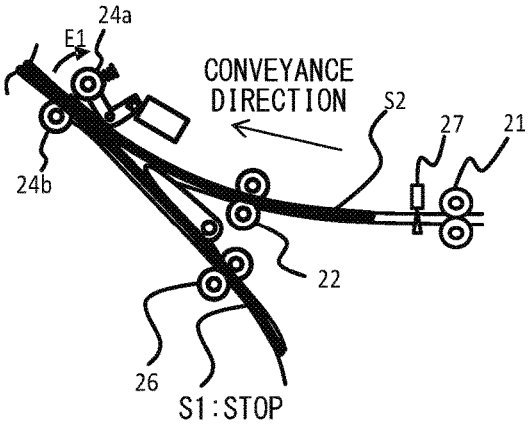
FIG. 14D is a section view schematically illustrating a still further phase of the conveyance operation in the second exemplary embodiment.
Figure 14E:
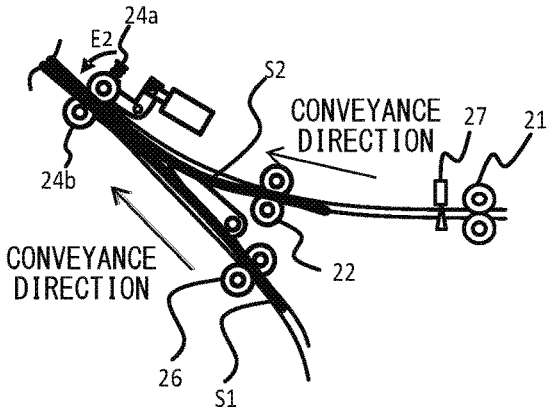
FIG. 14E is a section view schematically illustrating a differing phase of the conveyance operation in the second exemplary embodiment.
Figure 14F:
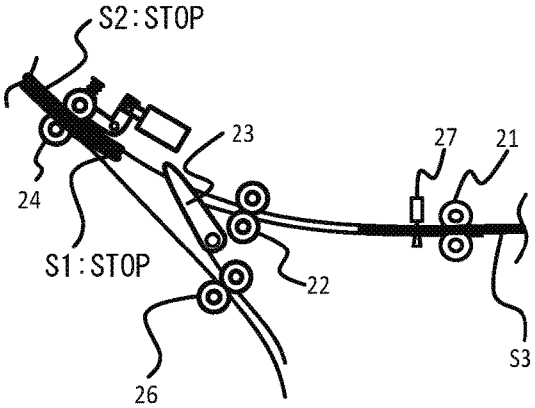
FIG. 14F is a section view schematically illustrating a final phase of the conveyance operation in the second exemplary embodiment.
Figure 15A:
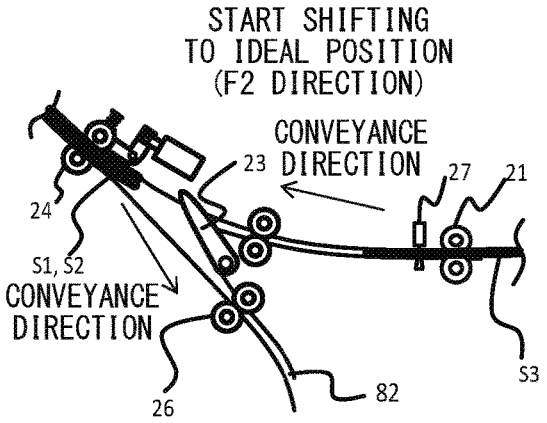
FIG. 15A is a section view schematically illustrating a phase of the conveyance operation including a buffering operation in the second exemplary embodiment.
Figure 15B:
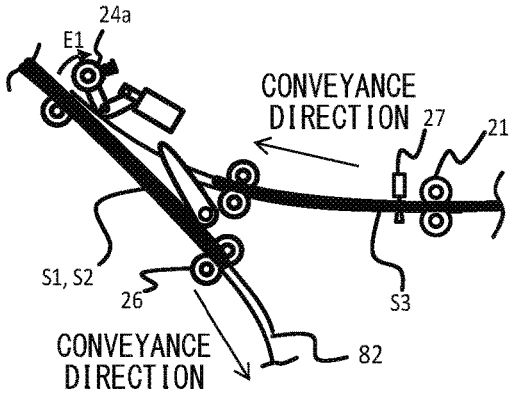
FIG. 15B is a section view schematically illustrating a next phase of the conveyance operation in the second exemplary embodiment.
Figure 15C:
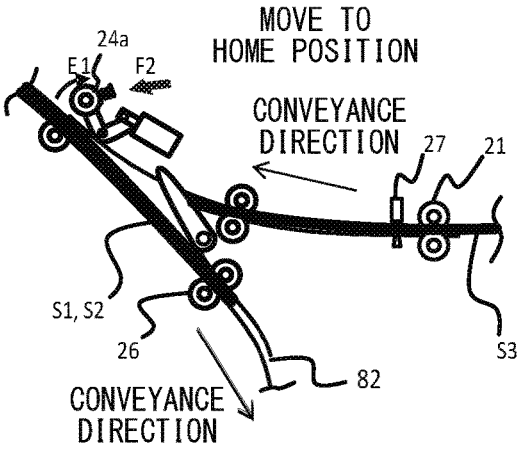
FIG. 15C is a section view schematically illustrating a further phase of the conveyance operation in the second exemplary embodiment.
Figure 15D:
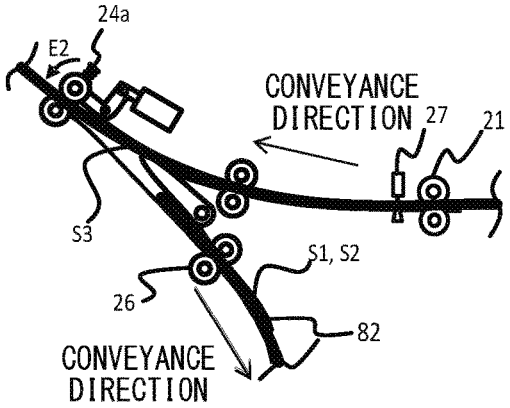
FIG. 15D is a section view schematically illustrating a still further phase of the conveyance operation in the second exemplary embodiment.
Figure 16A:
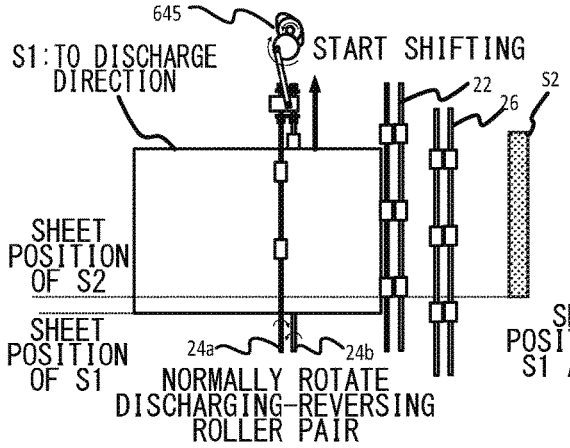
FIG. 16A is a section view schematically illustrating a phase of the conveyance operation including a buffering operation in the second exemplary embodiment
Figure 16B:
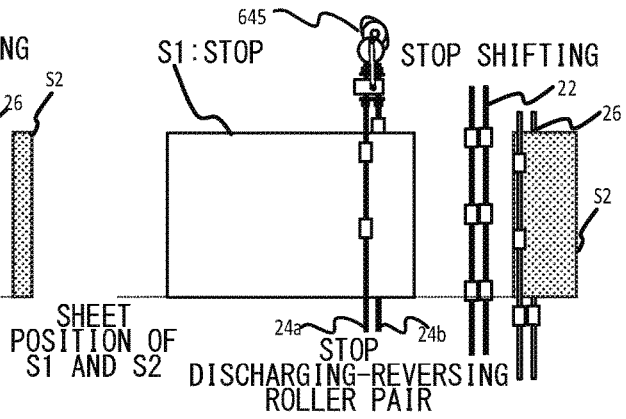
FIG. 16B is a section view schematically illustrating a next phase of the conveyance operation in the second exemplary embodiment.
Figure 16C:
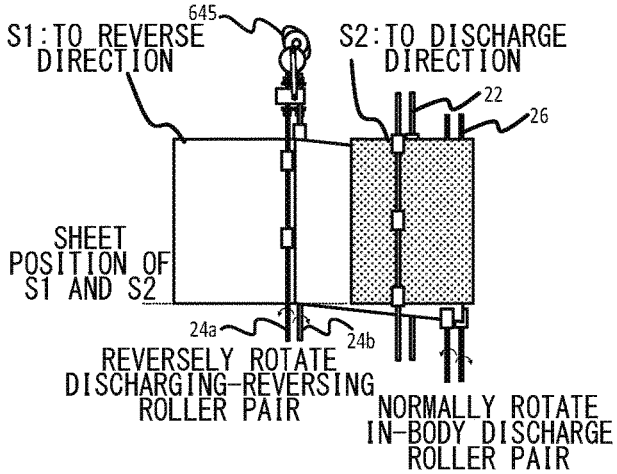
FIG. 16C is a section view schematically illustrating a further phase of the conveyance operation in the second exemplary embodiment.
Figure 16D:
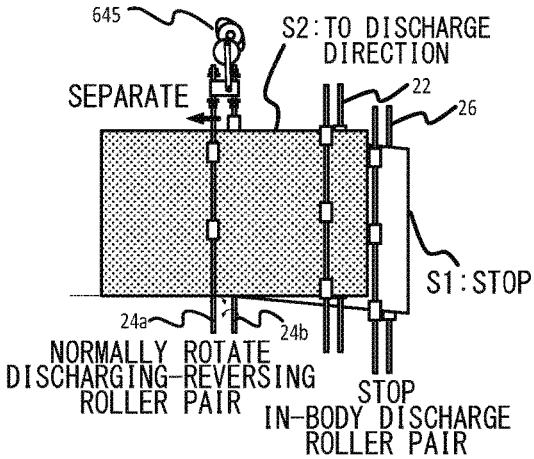
FIG. 16D is a section view schematically illustrating a next further phase of the conveyance operation in the second exemplary embodiment.
Figure 16E:
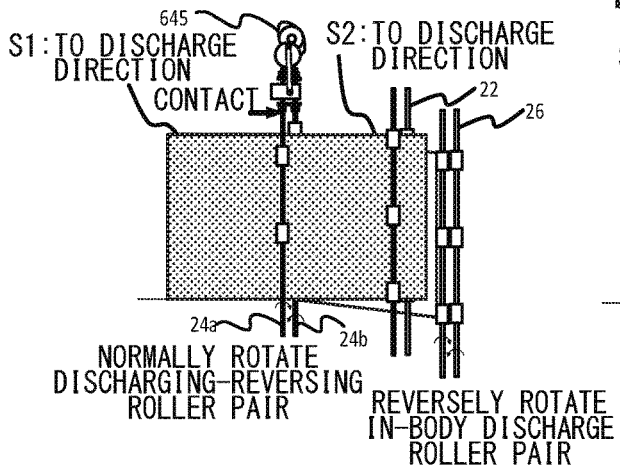
FIG. 16E is a section view schematically illustrating a still further phase of the conveyance operation in the second exemplary embodiment.
Figure 16F:
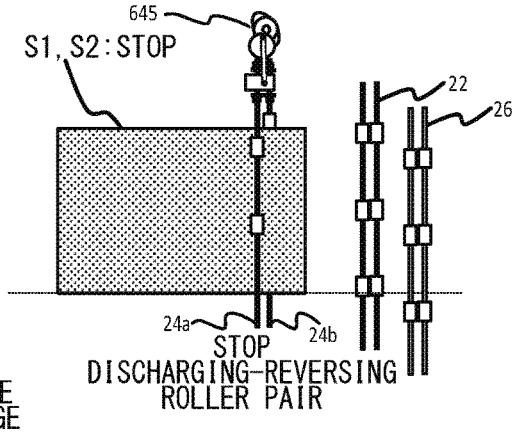
FIG. 16F is a section view schematically illustrating a final phase of the conveyance operation in the second exemplary embodiment.
Figure 17A:
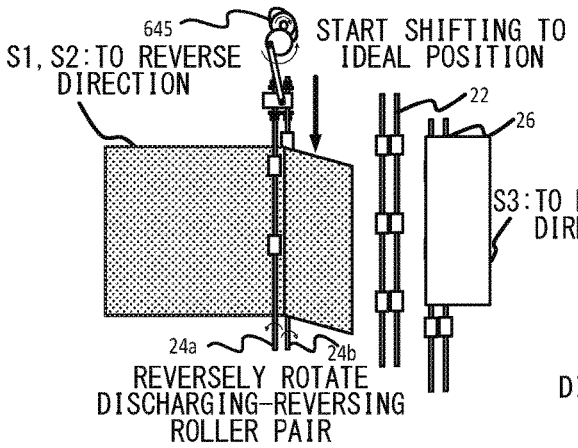
FIG. 17A is a section view schematically illustrating a phase of the conveyance operation including a buffering operation in the second exemplary embodiment.
Figure 17B:
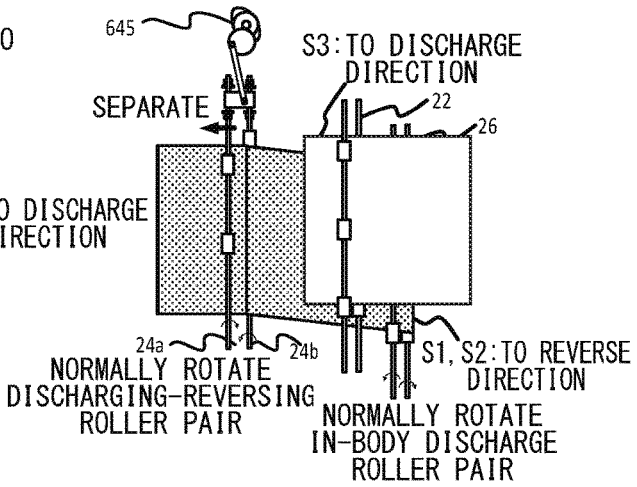
FIG. 17B is a section view schematically illustrating a next phase of the conveyance operation in the second exemplary embodiment.
Figure 17C:
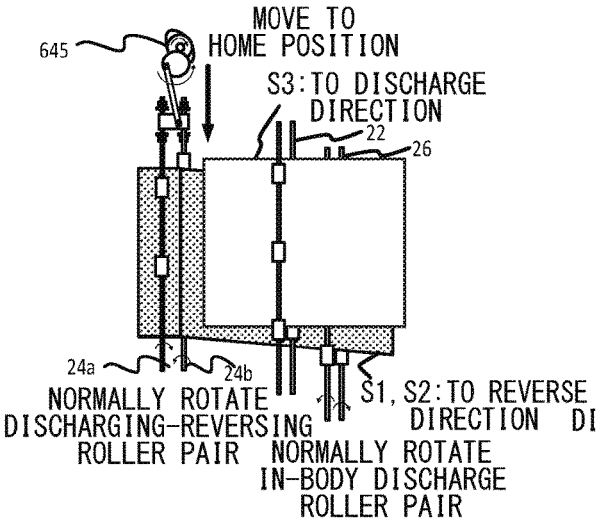
FIG. 17C is a section view schematically illustrating a further phase of the conveyance operation in the second exemplary embodiment.
Figure 17D:
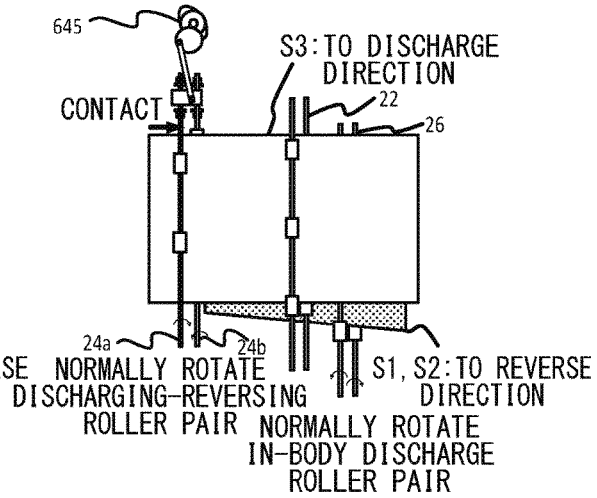
FIG. 17D is a section view schematically illustrating a final phase of the conveyance operation in the second exemplary embodiment.

1. The shift conveyance mechanism 24A starts the shift operation of the sheet S1 as illustrated in FIGS. 14A and 16A by driving the shift motor 645 at timing when a trailing edge of the sheet S1 conveyed from the entry path 81 to the discharging-reversing roller pair 24 passes through the pre-buffering roller pair 22. A shift amount of the sheet S1 at this time is a buffering shift amount calculated as a target position by setting a lateral position of the succeeding sheet S2 detected by the lateral position detection sensor 70 based on a lateral position of the sheet S1 detected by the lateral position detection sensor 70. That is, the sheet S1 is shifted to a position coincident with the lateral position of the sheet S2 detected by the lateral position detection sensor 70.

2. The discharging-reversing roller pair 24 temporarily stops the conveyance of the sheet S1 at timing when the trailing edge of the sheet S1 passes through the non-return flap 23. (see FIGS. 14B and 16B).

3. Next, the discharging-reversing roller pair 24 starts to rotate reversely to convey the sheet S1 toward the in-body discharge roller pair 26 (see FIGS. 14C and 16C).

4. The sheet S1 stops at a position to which the sheet S1 has been conveyed by a predetermined amount by the in-body discharge roller pair 26 (see FIGS. 14D and 16D). The discharging-reversing roller pair 24 separates at timing after the sheet S1 is nipped by the in-body discharge roller pair 26. Thereby, the sheet S1 being shifted in accordance to the lateral position of the succeeding sheet S2 is put into a state nipped by the in-body discharge roller pair 26. The succeeding sheet S2 enters the discharging-reversing roller pair 24 being separated. Still further, the discharging-reversing roller pair 24 reverses the rotation direction after the separation and is driven in the normal rotation direction.

5. The in-body discharge roller pair 26 starts to convey the sheet S1 toward the discharging-reversing roller pair 24 at timing when the sheet S2 is conveyed by a predetermined amount after the trailing edge of the succeeding sheet S2 has passed through the entrance sensor 27 (see FIGS. 14E and 16E). After that, the discharging-reversing roller pair 24 is caused to nip the sheets S1 and S2 whose lateral positions have been aligned by abutting the discharging-reversing roller pair 24 with the sheets S1 and S2 at timing when relative speeds of the sheets S1 and S2 are approximately equalized.

6. The discharging-reversing roller pair 24 again temporally stops after the trailing edges of the sheets S1 and S2 nipped by the discharging-reversing roller pair 24 pass through the non-return flap 23 (see FIGS. 14F and 16F).

7. Because the second sheet S2 is a final sheet to be buffered, the discharging-reversing roller pair 24 starts to shift the sheets S1 and S2 to an ideal sheet position, i.e., a sheet bundle shifting process, in sending the sheets S1 and S2 to the binding processing portion 4A (see FIGS. 15A and 17A). A shift amount of the sheet bundles (S1 and S2) buffered at this time is a reversed shift amount calculated as a move amount from the lateral position detected by the lateral position detection sensor 70 about the sheet to be buffered last, i.e., the sheet S2 here, to the target position of the sheet bundle. Still further, in parallel with the shift operation, the discharging-reversing roller pair 24 rotates in the reverse direction to convey the sheets S1 and S2 toward the in-body discharge roller pair 26.

8. The discharging-reversing roller pair 24 starts to separate at timing after the sheets S1 and S2 are nipped by the in-body discharge roller pair 26 to be ready to receive a next sheet S3 (see FIGS. 15B and 17B).

9. When the discharging-reversing roller pair 24 separates, the discharging-reversing roller pair 24 starts to move to the home position (see FIGS. 15C and 17C).

10. After the trailing edges of the sheets S1 and S2, i.e., the trailing edge in the forward conveyance direction of the in-body discharge path 82, passes through the discharging-reversing roller pair 24, the discharging-reversing roller pair 24 comes into contact again and nips and conveys the next sheet S3 (see FIGS. 15D and 17D).

It is possible to buffer the plurality of sheets while overlaying them on one another by the discharging-reversing roller pair 24 by repeating the abovementioned operations. Note that in a case of buffering three or more sheets, the buffering can be realized by repeating the above operations 1 through 5.

Figure 18:
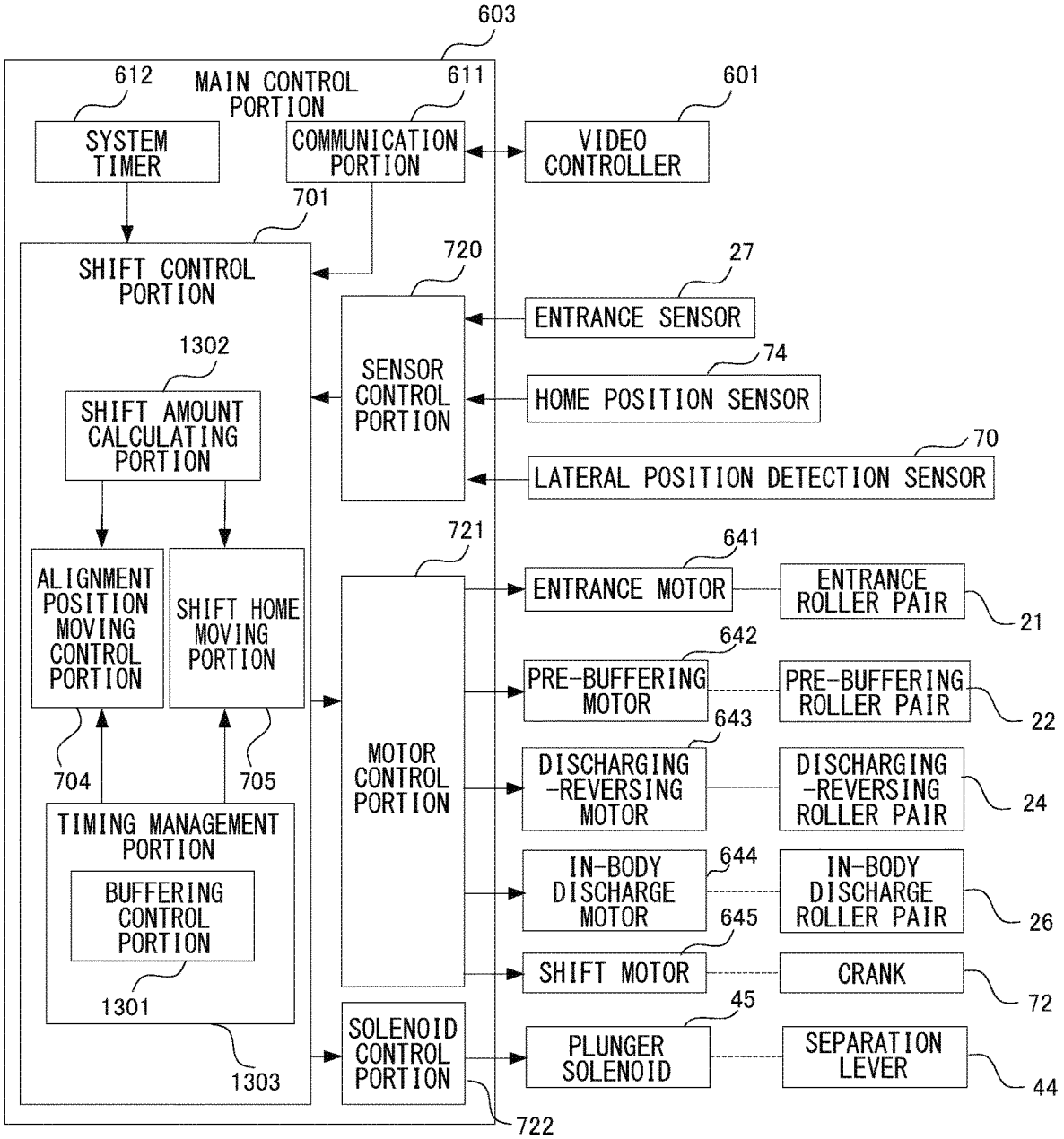
FIG. 18 is a control block diagram of the second exemplary embodiment

Next, a functional block of the present exemplary embodiment will be described with reference to FIG. 18. Here, parts different from the first exemplary embodiment, i.e., a shift amount calculating portion 1302 and a timing management portion 1303 of the shift control portion 701, will be described below.

The shift amount calculating portion 1302 calculates a buffering shift amount for aligning and buffering the conveyed sheet based on sheet width information specified by the video controller 601, sheet buffering information, and sheet lateral position information received from the sensor control portion 720. The shift amount calculating portion 1302 also calculates a reverse shift amount for adjusting a lateral position of a sheet bundle to an ideal sheet position in sending the sheet bundle formed by the buffering operation to the in-body discharge path 82. The shift amount calculating portion 1302 notifies these shift amounts to the alignment position moving control portion 704 and instructs the shift home moving portion 705 about a rotation direction of the motor.

The timing management portion 1303 has a function of notifying timing when the shift control should be executed to the alignment position moving control portion 704 based on signal information of the entrance sensor 27 received from the sensor control portion 720. The timing management portion 1303 also has a function of notifying timing when the shift conveyance mechanism 24A should be moved to the home position to the shift home moving portion 705. The timing management portion 1303 of the present exemplary embodiment also includes a buffering control portion 1301 for controlling the motor and solenoid for realizing the buffering operation.

Control Method of Plural-Sheet Alignment Control

Figure 19A:
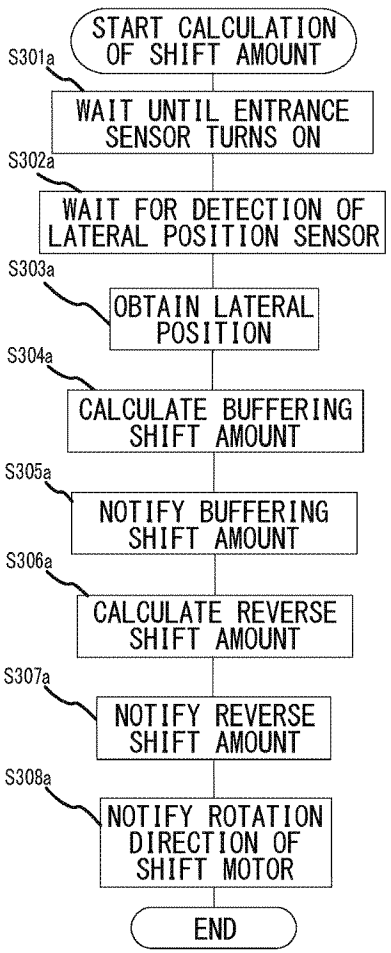
FIG. 19A is a control flow diagram of a part of a plural-sheet alignment control according to the second exemplary embodiment.

A control flow of a plural-sheet alignment control will be described with reference to FIGS. 19A through 20B. FIG. 19A illustrates a control flow of the shift amount calculating portion 1302. The shift amount calculating portion 1302 starts at timing when a sheet width is notified from the video controller 601 and waits until the entrance sensor 27 detects a leading edge of the sheet passed from the image forming apparatus 1 to the post-processing apparatus 4 in Step S301*a*. Next, starting at the timing when the entrance sensor 27 detects the leading edge of the sheet, i.e., the sensor turns ON, the shift amount calculating portion 1302 waits until the lateral position detection sensor 70 detects a lateral position of the sheet in Step S302*a* and obtains the lateral position of the detected sheet in Step S303*a*. Then, the shift amount calculating portion 1302 calculates a buffering shift amount from the obtained lateral position, sheet width information specified by the video controller 601 and sheet buffer information, i.e., information specifying the sheet which is to be buffered, in Step S304*a*. Then, the shift amount calculating portion 1302 notifies the calculated shift amount to the alignment position moving control portion 704 in Step S305*a*, calculates the reverse shift amount in the same manner in Step S306*a* and notifies the reversed shift amount to the alignment position moving control portion 704 in Step S307*a*. The shift amount calculating portion 1302 also notifies a rotation direction of the shift motor 645 in returning to the home position to the shift home moving portion 705 in Step S308*a*.

Figure 19B:
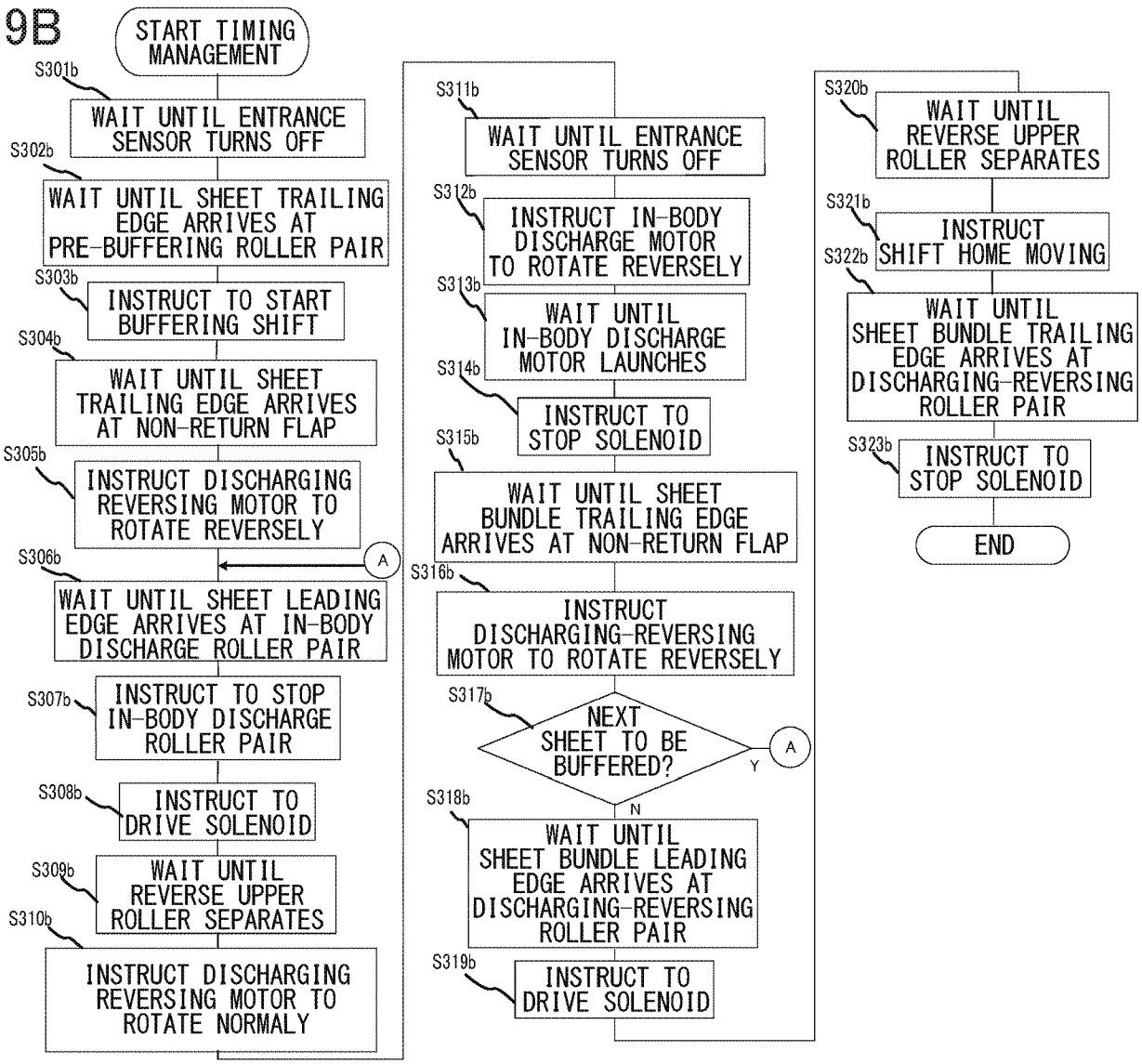
FIG. 19B is a control flow diagram of another part of the plural-sheet alignment control according to the second exemplary embodiment

FIG. 19B illustrates a control flow of the timing management portion 1303. Because the timing management portion 1303 contains the buffering control portion 1301, the control flow also contains the flow of the buffering control portion 1301.

The timing management portion 1303 starts at timing when the leading edge of the sheet arrives at the entrance sensor 27 and waits until the entrance sensor 27 detects the trailing edge of the sheet passed from the image forming apparatus 1 to the post-processing apparatus 4 in Step S301*b*. Next, with the timing when the entrance sensor 27 detects the trailing edge of the sheet, i.e., the sensor is turned OFF, as a starting-point, the timing management portion 1303 waits until the trailing edge of the sheet arrives at the pre-buffering roller pair 22 in Step S302*b*. The timing management portion 1303 instructs the alignment position moving control portion 704 to start the buffering shift at the timing when the trailing edge of the sheet arrives at the pre-buffering roller pair 22 in Step S303*b* and waits further until the trailing edge of the sheet arrives at the non-return flap 23 in Step S304*b*. At the timing when the trailing edge of the sheet arrives at the non-return flap 23, the timing management portion 1303 instructs the discharging-reversing motor 643 to rotate reversely in Step S305*b* and waits until the leading edge of the sheet arrives at the in-body discharge roller pair 26 in Step S306*b*. When the leading edge of the sheet arrives at the in-body discharge roller pair 26, the timing management portion 1303 instructs the in-body discharge motor 644 to stop in Step S307*b* and instructs to energize the plunger solenoid 45 in Step S308*b*. By the processes so far, the sheet to be buffered is nipped by the in-body discharge roller pair 26, and the discharging-reversing roller pair 24 is separated to receive a next sheet to be buffered (see FIGS. 14D and 16D).

Next, after waiting the separation of the discharging-reversing roller pair 24 in Step S309*b*, the timing management portion 1303 instructs the discharging-reversing motor 643 to rotate normally in Step S310*b*. After waiting until a trailing edge of the next sheet is detected by the entrance sensor 27 in Step S311*b*, the timing management portion 1303 instructs the in-body discharge roller pair 26 to rotate reversely in Step S312*b*, and after waiting until the in-body discharge roller pair 26 starts up in Step S313*b*, the timing management portion 1303 instructs to stop to energize the plunger solenoid 45 in Step S314*b*. By the processes so far, the sheet which has held by the in-body discharge roller pair 26 and the sheet conveyed by the pre-buffering roller pair 22 join and overlap with each other at the discharging-reversing roller pair 24 (see FIGS. 14E and 16E).

In succession, the timing management portion 1303 waits for a time until the trailing edge of the sheet bundle arrives at the non-return flap 23 in Step S315*b* and instructs the discharging-reversing motor 643 to rotate reversely in Step S316*b*. Then, the timing management portion 1303 judges whether a sheet conveyed next is to be buffered in the buffering operation of this time based on an instruction of the video controller in Step S317*b*. In a case where the sheet conveyed next is also an object of the buffering operation of this time, the timing management portion 1303 returns to Step S306*b* to repeat the abovementioned processes. In a case where the sheet conveyed next is not an object of the buffering, the timing management portion 1303 advances to Step S318*b* to perform the following processes.

After waiting until the buffered sheet bundle arrives at the in-body discharge roller pair 26 in Step S316*b* by the discharging-reversing roller pair 24 that starts to rotate reversely in Step S318*b*, the timing management portion 1303 instructs to energize the plunger solenoid 45 in Step S319*b*. Then, after waiting for a time when the discharging-reversing roller pair 24 separates in Step S320*b*, the timing management portion 1303 instructs the shift home moving portion 705 to move to the home position in Step S321*b*. After waiting for a time when the trailing edge of the buffered sheet bundle, i.e., the trailing edge of the sheet bundle in the forward conveyance direction of the in-body discharge path 82, arrives at the discharging-reversing roller pair 24 in Step S322*b*, the timing management portion 1303 instructs to stop the energization of the plunger solenoid 45 in Step S323*b*.

Figure 20A:
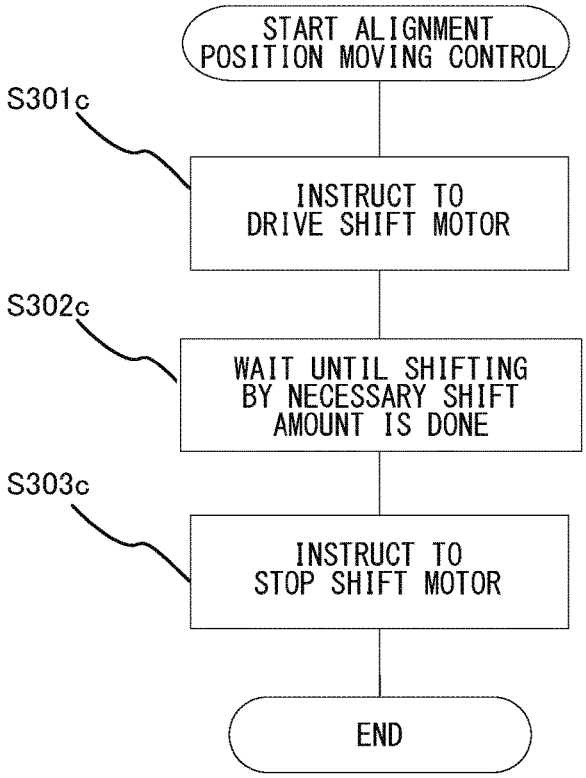
FIG. 20A is a control flow diagram of still another part of the plural-sheet alignment control according to the second exemplary embodiment.

FIG. 20A illustrates a control flow of the alignment position moving control portion 704 and is the same with that of the single-sheet alignment control (see FIGS. 10A and 13A) in which the upper discharge tray 25 or the lower discharge tray 37 is set as the discharge destination. That is, because the contents of the respective steps S301*c* through S303*c* are the same with the contents of Steps S201*c* through S203*c* in FIG. 13A, their description will be omitted here.

Note that according to the present exemplary embodiment, the alignment position moving control portion 704 includes cases where the alignment position moving control portion 704 controls the shift operation of the discharging-reversing roller pair 24 based on the buffering shift amount and controls the shift operation of the discharging-reversing roller pair 24 based on the reversed shift amount. The former shift operation based on the buffering shift amount is a shift operation of aligning the sheets in the plural-sheet alignment control, i.e., the second alignment process. The latter shift operation based on the reversed shift amount is a sheet bundle shifting process of shifting a sheet bundle composed of a plurality of sheets aligned by the plural-sheet alignment control toward the target position of the sheet bundle before sending into the in-body discharge path 82. In other words, the sheet bundle shifting process is a process of moving the plurality of sheets overlaid on one another while being aligned by the second alignment control of the present exemplary embodiment to the widthwise target position of the sheet bundle.

Figure 20B:
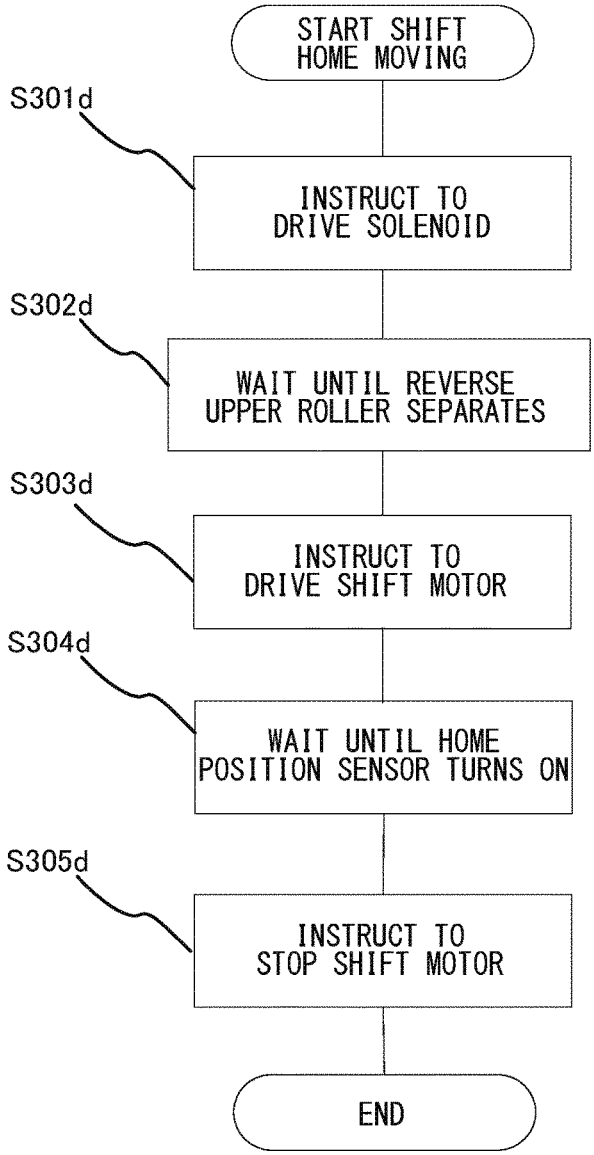
FIG. 20B is a control flow diagram of still another part of the plural-sheet alignment control according to the second exemplary embodiment.

FIG. 20B illustrates a control flow of the shift home moving portion 705 and is the same with the single-sheet alignment control (see FIG. 13B) in which the lower discharge tray 37 is set as the discharge destination. That is, because the contents of the respective steps S301*d* through S305*d* are the same with the contents of Steps S201*d* through S205*d* in FIG. 13B, their description will be omitted here.

Summary of Second Exemplary Embodiment

As described above, the present exemplary embodiment makes it possible to perform the plural-sheet alignment control that aligns, while buffering, the plurality of sheets for at least one discharge destination in addition to the single-sheet alignment control of the sheet to be discharged to the plurality of discharge destinations. Thereby, it is not necessary to widen intervals of image forming operations in the image forming apparatus 1 for the reason of processing waiting in the binding processing portion 4A, thus contributing to the improvement of productivity of the image forming system 1S. Because the buffered plurality of sheets in which sheets are overlaid on one another while being aligned at this time, alignment quality of the sheet to be processed in the binding processing portion 4A improves as compared to a case where the plural-sheet alignment control is not performed.

Third Exemplary Embodiment

A configuration of a post-processing apparatus of a third exemplary embodiment will be described. The present exemplary embodiment is characterized in that a shift processing, i.e., an offset buffering control, is performed such that sheet positions offset among the plurality of sheets overlaid on one another as a sheet bundle by the buffering operation of the buffering portion 4B. That is, the offset buffering control is a control of overlaying a succeeding sheet on a preceding sheet while offsetting them in the width direction. Note that component parts having the same configurations and same operations with those of the first and second exemplary embodiments will be denoted by the common reference signs with those of the first and second exemplary embodiments and their description will be omitted here.

Figure 23:
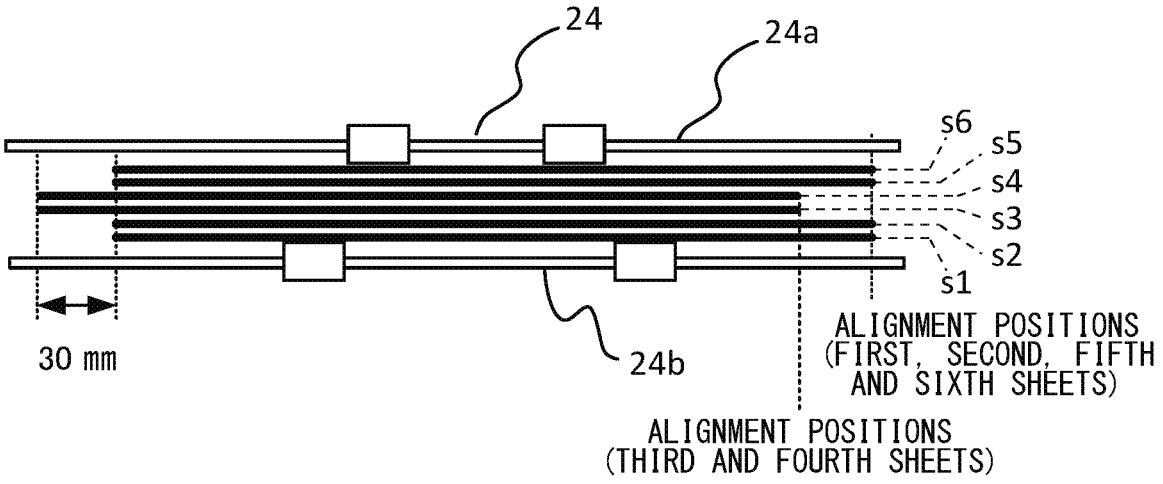
FIG. 23 is a schematic diagram illustrating a state of sheets discharged in offset according to the third exemplary embodiment.

According to the present exemplary embodiment, it is presumed that an offset amount is notified from the video controller to a main control portion of the post-processing apparatus 4 per every sheet. FIG. 23 illustrates an image of a sheet bundle held by the discharging-reversing roller pair 24 in a case where the offset buffering control is executed in accordance to an offset amount notified per sheet.

Here, it is presumed that the buffering operation is performed on six sheets as one set in the buffering portion 4B. Assume here that an offset amount of first two sheets is specified as '0 mm', an offset amount of next two sheets is specified as '30 mm' and an offset amount of final two sheets is specified as '0 mm'. In this case, lateral positions of the first, second, fifth and sixth sheets s1, s2, s5 and s6 whose offset amount is 0 mm are aligned with each other. On the other hand, lateral positions of the third and fourth sheets s3 and s4 whose offset amount is 30 mm are aligned with each other and are also aligned at a position offset by 30 mm with respect to the alignment position of the first, second, fifth and sixth sheets s1, s2, s5 and s6. As a whole, a sheet bundle in which the middle two sheets, i.e., the third and fourth sheets s3 and s4, among the six sheets are offset in one widthwise direction as compared to the remaining four sheets is formed. A configuration for realizing such offset buffering control will be described below.

Figure 21:
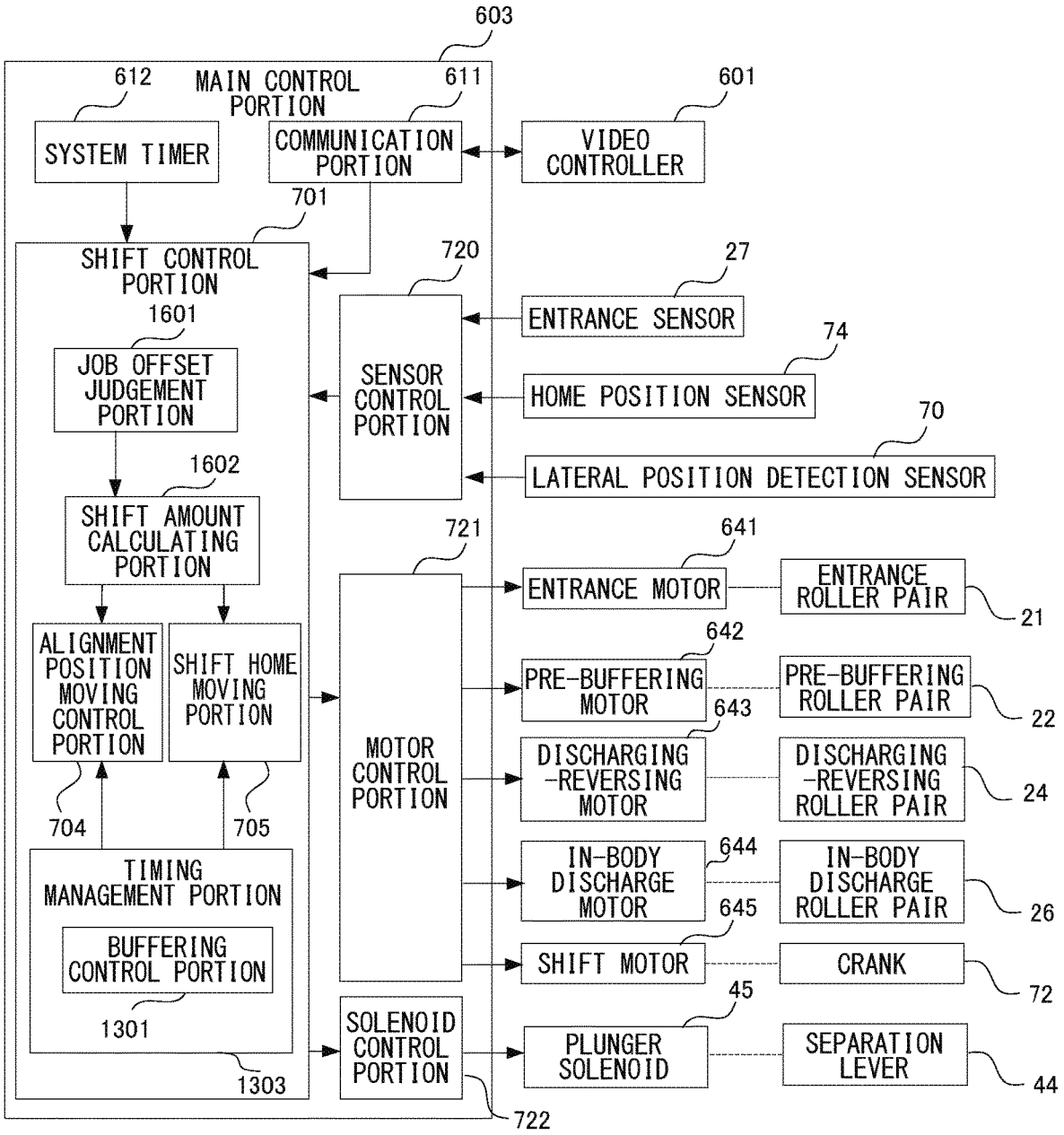
FIG. 21 is a control block diagram according to a third exemplary embodiment.

FIG. 21 illustrates a functional block of the present exemplary embodiment. Note that, only parts different from the second exemplary embodiment (see FIG. 18), i.e., a job offset judgement portion 1601 and a shift amount calculating portion 1602, will be described below.

The job offset judgement portion 1601 has functions of confirming an offset request received by the communication portion 611 from the video controller 601 and of notifying the offset amount to the shift amount calculating portion 1602 in a case where it is necessary to offset. The video controller 601 issues the offset request in a form of numerical value or the like specifying the offset amount of the sheet per each sheet delivered from the image forming apparatus 1 being in operation to the post-processing apparatus 4.

The shift amount calculating portion 1602 has a function of calculating a buffering shift amount based on sheet width information and sheet buffering information specified from the video controller 601, the offset amount notified from the job offset judgement portion 1601 and sheet lateral position information received from the sensor control portion 720. The buffering shift amount of the present exemplary embodiment is a shift amount for shifting sheets being held in the buffering portion 4B such that a new sheet to be buffered is overlaid while offset with the specified offset amount in overlaying the new sheet to the sheets held in the buffering portion 4B. The shift amount calculating portion 1602 also calculates a reversed shift amount for adjusting a lateral position of a sheet bundle formed by the buffering operation to an ideal sheet position in sending the sheet bundle to the in-body discharge path 82. The shift amount calculating portion 1302 notifies these shift amounts to the alignment position moving control portion 704 and instructs a rotation direction of the motor to the shift home moving portion 705.

Figure 22:
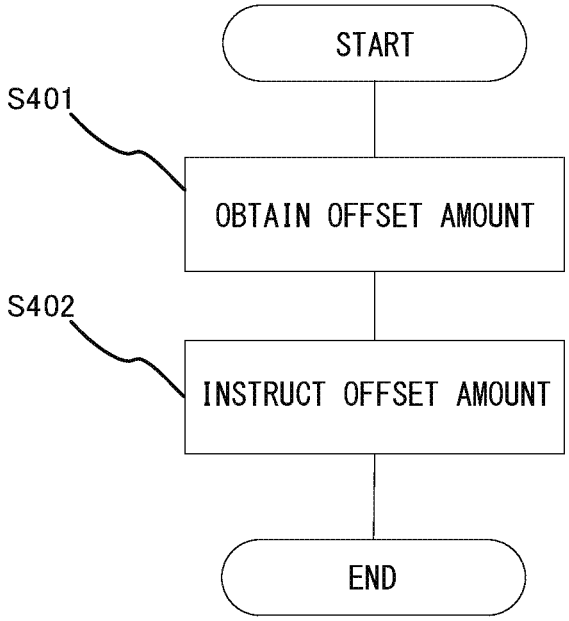
FIG. 22 illustrates a control flow of an offset buffering control according to the third exemplary embodiment.

Next, a control flow regarding the offset buffering control will be described with reference to FIG. 22. FIG. 22 illustrates the control flow of the job offset judgement portion 1601. The job offset judgement portion 1601 starts up at timing of receiving offset information from the video controller 601 and confirms the offset request per every sheet received from the video controller 601 in Step S401. Then, the job offset judgement portion 1601 notifies the contents of the offset request as an offset amount to the shift amount calculating portion 1602 in Step S402.

Receiving the notification of the offset amount from the job offset judgement portion 1601, the shift amount calculating portion 1602 calculates the buffering shift amount in accordance to the specified offset amount. More specifically, the buffering shift amount of the present exemplary embodiment is what the offset amount notified from the job offset judgement portion 1601 is added to the buffering shift amount (see S304*a* in FIG. 19A) of the second exemplary embodiment that simply aligns the sheets without offsetting.

Because other steps of the control flow regarding the shift amount calculating portion 1602 and the control flows of the timing management portion 1303, the alignment position moving control portion 704 and the shift home moving portion 705 are the same with those described in the second exemplary embodiment, their description will be omitted here.

Thus, according to the present exemplary embodiment, it is possible to form the sheet bundle in which the sheets are overlaid on one another while offsetting with each other by executing the offset buffering control in the buffering operation.

Here, in a case where a discharge position is offset every time when a predetermined number of sheets is discharged on the lower discharge tray 37, it is conceivable to arrange the bundle discharge roller 36 as a shift roller movable in the width direction. However, if the discharge position is to be offset every time when a small number of sheets, e.g., a few sheets, is discharged with this arrangement, the productivity may drop because a shift operation and a return operation of the shift roller need to be frequently carried out. In contrast, the present exemplary embodiment contributes to the improvement of productivity of the image forming system by utilizing the buffering operation in the buffering portion 4B for conducting the offset discharge of such a small number of sheets.

Other Embodiments

The post-processing apparatus 4 directly connected to the image forming apparatus 1 has been described as an example of the sheet processing unit in the first through third exemplary embodiments. Note that, the technology of the present disclosure is also applicable to a sheet processing apparatus that receives a sheet from the image forming apparatus 1 through an intermediate unit, e.g., a relay conveyance unit attached to a discharge space in an in-body discharge type image forming apparatus. Still further, "the image forming system including the sheet processing apparatus and the image forming apparatus" includes an apparatus in which a module(s) having the functions of the image forming apparatus 1 and the post-processing apparatus 4 is(are) mounted in a single casing.

The stapler 51 is one example of the processing unit configured to process sheets and may be arranged so as to discharge a sheet bundle aligned in the intermediate stacking portion to the lower discharge tray 37 without binding the sheet bundle. Still further, the post-processing apparatus 4 in the above embodiments is an example of the sheet conveyance apparatus configured to convey a sheet and is applicable also to a sheet conveyance apparatus other than a sheet processing unit configured to process a sheet, i.e., a recording member, on which an image has been formed by the image forming apparatus.

Embodiment(s) of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2019-138321, filed on Jul. 26, 2019, which is hereby incorporated by reference herein in its entirety.

What is claimed is:

1. A sheet conveyance apparatus comprising:

a first conveyance path through which a sheet is conveyed toward a first discharge member;

a detector provided on the first conveyance path and configured to detect a position of the sheet in a width direction perpendicular to a discharge direction toward the first discharge member;

a second conveyance path which is branched from the first conveyance path and through which the sheet reversed from the discharge direction in the first conveyance path is conveyed in a case where the sheet is to be discharged to a second discharge member other than the first discharge member;

a discharger provided downstream in the discharge direction of a position where the second conveyance path branches from the first conveyance path, the discharger being movable in the width direction and being configured to perform a discharge operation of discharging the sheet onto the first discharge member and a reversing operation of reversing and conveying the sheet to the second conveyance path; and a controller configured to control the discharger and to execute a first alignment control when the reversing operation is performed, the first alignment control being a control in which the discharger moves the sheet in the width direction based on the position of the sheet detected by the detector to align the sheet at a target position.

2. The sheet conveyance apparatus according to claim 1, wherein the controller is configured to execute the first alignment control when the discharge operation is performed.

3. The sheet conveyance apparatus according to claim 1, further comprising a conveyor provided on the second conveyance path and capable of nipping and conveying the sheet in a forward conveyance direction and in a backward conveyance direction in the second conveyance path, wherein the discharger and the conveyor are configured to perform a buffering operation of buffering a plurality of sheets, which are conveyed one by one through the first conveyance path, by overlaying the plurality of sheets on one another.

4. The sheet conveyance apparatus according to claim 3, wherein the controller is configured to execute a second alignment control when the buffering operation is performed, the second alignment control being a control in which the discharger moves and adjusts a position in the width direction of a preceding sheet having arrived at the discharger is moved in the width direction in accordance to a position detected by the detector on a succeeding sheet conveyed toward the discharger following the preceding sheet.

5. The sheet conveyance apparatus according to claim 4, wherein the controller is configured to cause the plurality of sheets, which have been overlaid on one another and aligned by the second alignment control, to be delivered to the conveyor after performing a process of moving the plurality of sheets to a target position of a sheet bundle in the width direction by the discharger.

6. The sheet conveyance apparatus according to claim 3, wherein the controller is configured to execute, when the buffering operation is performed, a control of overlaying a succeeding sheet on a preceding sheet with an offset in the width direction by moving a position in the width direction of the preceding sheet having arrived at the discharger in the width direction based on a position detected by the detector on the succeeding sheet, the succeeding sheet being a sheet to be conveyed to the discharger following the preceding sheet.

7. The sheet conveyance apparatus according to claim 1, wherein the discharger comprises a roller pair configured to convey the sheet in the discharge direction and in a direction opposite to the discharge direction and a moving member configured to move the roller pair in the width direction.

8. The sheet conveyance apparatus according to claim 7, wherein the discharger further comprises a separator configured to bring the roller pair in contact and to separate the roller pair from each other, and wherein the moving member is configured to move the roller pair in the width direction in either state where the roller pair is in contact with or is separated from each other.

9. The sheet conveyance apparatus according to claim 1, further comprising:

the first discharge member comprising a first discharge tray;

the second discharge member comprising a second discharge tray;

an intermediate stacker provided downstream of the second conveyance path in a sheet conveyance direction of the second conveyance path; and a processor configured to perform a process on sheets stacked on the intermediate stacker, wherein the sheet discharged by the discharger is stacked onto the first discharge tray and the sheet that is conveyed via the intermediate stacker is discharged onto the second discharge tray.

10. The sheet conveyance apparatus according to claim 9, further comprising:

a regulating member configured to abut with a leading edge of a sheet discharged out of the second conveyance path onto the intermediate stacker to regulate a sheet position;

a pushing member configured to abut with the leading edge of the sheet processed by the processor to push the sheet in a pushing direction opposite to a sheet discharge direction in which the sheet is discharged from the second conveyance path to the intermediate stacker;

a third conveyance path that extends downstream in the pushing direction from the intermediate stacker; and a discharge member disposed on the third conveyance path and configured to discharge the sheet pushed out by the pushing member from the intermediate stacker to the second discharge member.

11. An image forming system comprising:

an image former configured to form an image on a sheet; and the sheet conveyance apparatus, as set forth in claim 1, configured to discharge the sheet on which the image has been formed by the image forming apparatus.

12. A sheet conveyance apparatus comprising:

a first conveyance path through which a sheet is conveyed toward a first discharge member;

a detector provided on the first conveyance path and configured to detect a position of the sheet in a width direction perpendicular to a discharge direction toward the first discharge member;

a second conveyance path which is branched from the first conveyance path and through which the sheet reversed from the discharge direction in the first conveyance path is conveyed in a case where the sheet is to be discharged to a second discharge member other than the first discharge member;

a discharger provided downstream in the discharge direction of a position where the second conveyance path branches from the first conveyance path, the discharger being movable in the width direction and being configured to perform a discharge operation of discharging the sheet onto the first discharge member and a reversing operation of reversing and conveying the sheet to the second conveyance path;

a conveyor provided on the second conveyance path and capable of nipping and conveying the sheet in a forward conveyance direction and a backward conveyance direction in the second conveyance path, the discharger and the conveyor being configured to perform a buffering operation of buffering a plurality of sheets, which are conveyed one by one through the first conveyance path, by overlaying the plurality of sheets on one another; and a controller configured to control the discharger and to execute an alignment control when the buffering operation is performed, the alignment control being a control in which the discharger moves and adjusts a position in the width direction of a preceding sheet having arrived at the discharger in the width direction in accordance to a position detected by the detector on a succeeding sheet conveyed toward the discharger following the preceding sheet.

* * * * *